US012263414B2

(12) United States Patent
Barrera et al.

(10) Patent No.: US 12,263,414 B2
(45) Date of Patent: Apr. 1, 2025

(54) CONJOINED MULTIPLE BOWL WATER SLIDE FEATURE

(71) Applicant: WHITEWATER WEST INDUSTRIES LTD., Richmond (CA)

(72) Inventors: Claudio Barrera, White Rock (CA); Boxiao Hu, Coquitlam (CA); Ben Cornwell-Mott, Comox (CA); Ross Flavell, Coquitlam (CA); Bruce Bradley, Vancouver (CA)

(73) Assignee: WHITEWATER WEST INDUSTRIES LTD., Richmond (CA)

( * ) Notice: Subject to any disclaimer, the term of this patent is extended or adjusted under 35 U.S.C. 154(b) by 207 days.

(21) Appl. No.: 18/055,828

(22) Filed: Nov. 15, 2022

(65) Prior Publication Data

US 2023/0285867 A1 Sep. 14, 2023

Related U.S. Application Data

(60) Provisional application No. 63/264,087, filed on Nov. 15, 2021.

(51) Int. Cl.
*A63G 21/18* (2006.01)

(52) U.S. Cl.
CPC ..... *A63G 21/18* (2013.01)

(58) Field of Classification Search
None
See application file for complete search history.

(56) References Cited

U.S. PATENT DOCUMENTS 548,256 A * 10/1895 Idler ..... A63G 21/18 104/70
1,926,780 A * 9/1933 Lippincott ..... A63G 21/18 104/73
4,805,896 A * 2/1989 Moody ..... A63G 3/00 472/117

(Continued)

FOREIGN PATENT DOCUMENTS

CA 3020726 C 3/2020
CA 2951552 C 7/2020

(Continued)

OTHER PUBLICATIONS

International Search Report and Written Opinion for International Application No. PCT/CA2022/051686, dated Feb. 17, 2023, 8 pages.

*Primary Examiner* — Joseph A Dillon, Jr.
(74) *Attorney, Agent, or Firm* — Buchalter, a Professional Corporation

(57) ABSTRACT

A ride feature is disclosed using conjoined bowl structures formed of multiple bowl structures attached to each other. In a two bowl embodiment, the ride vehicle rides about at least a portion of a periphery of a first bowl structure and then about at least a portion of a periphery of a second bowl structure before exiting the ride feature. The ride vehicle may exit the conjoined bowl structure from either the first bowl structure or the second bowl structure. In alternative embodiments, the conjoined bowl feature may be comprised of more than two conjoined bowls, the bowls may be of different diameter, and/or the bowls may have a constantly decreasing or increasing diameter.

7 Claims, 15 Drawing Sheets

(56) References Cited

U.S. PATENT DOCUMENTS 5,433,671 A * 7/1995 Davis ..... A63G 31/007 472/117
5,738,590 A * 4/1998 Lochtefeld ..... A63G 31/007 472/117
6,485,372 B2 * 11/2002 Stuart ..... A63G 21/18 472/117
6,991,548 B2 * 1/2006 Arie ..... A63K 1/00 472/88
7,008,329 B2 * 3/2006 Hunter ..... A63G 21/18 472/117
7,780,537 B2 * 8/2010 Hlynka ..... A63G 21/18 472/117
7,887,426 B2 * 2/2011 Hlynka ..... A63G 21/18 472/117
8,579,715 B2 * 11/2013 Olive ..... A63G 21/18 472/117
8,784,224 B1 * 7/2014 Schafer ..... A63G 21/18 472/117
9,440,155 B2 * 9/2016 Fischer ..... A63G 21/10
11,141,666 B2 * 10/2021 Chutter ..... A63G 21/18
11,260,309 B2 * 3/2022 Hunter ..... A63G 31/007
D1,027,091 S * 5/2024 Schmit ..... D21/818
2006/0111196 A1 * 5/2006 Henry ..... A63G 29/00 472/128
2009/0105003 A1 * 4/2009 Stuart ..... A63G 21/18 198/617
2012/0122598 A1 5/2012 Spiroglu
2013/0184087 A1 * 7/2013 Degirmenci ..... A63G 21/04 472/117
2023/0415049 A1 * 12/2023 Frankowski ..... A63G 21/18

FOREIGN PATENT DOCUMENTS

CA 3026595 C 5/2021
WO 2023082026 A1 5/2023

* cited by examiner

FIG. 8A
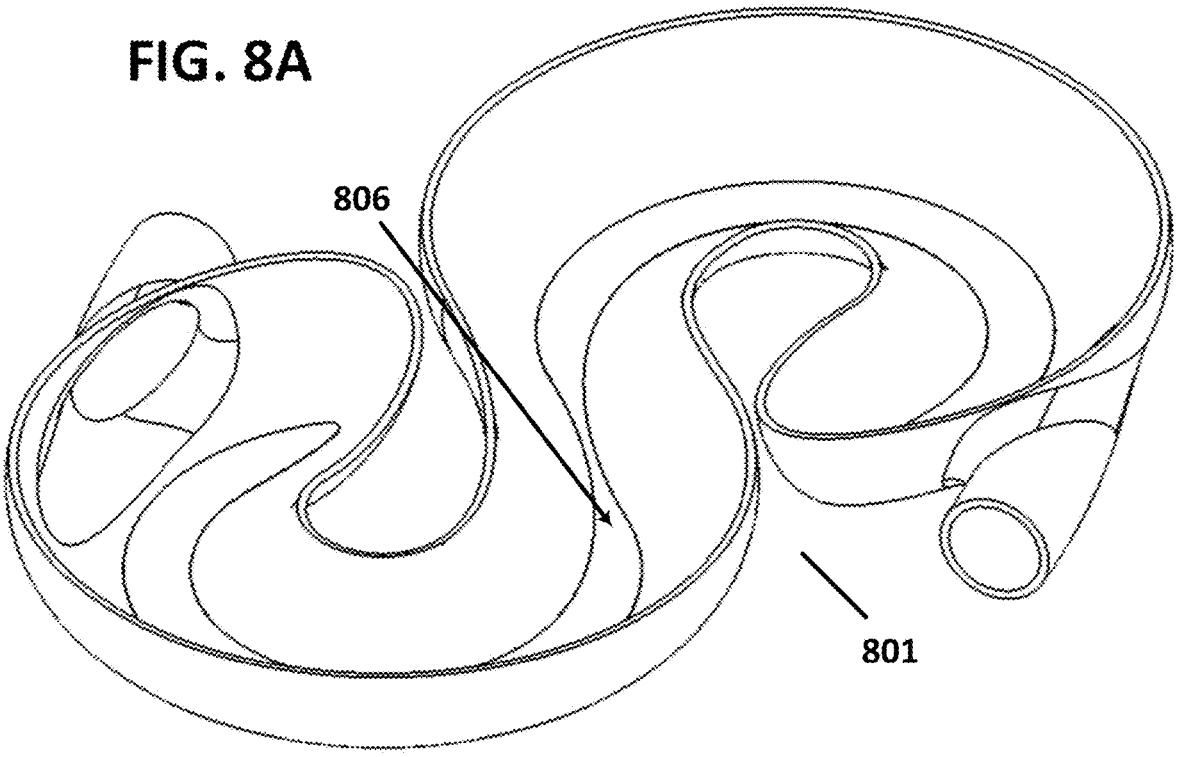
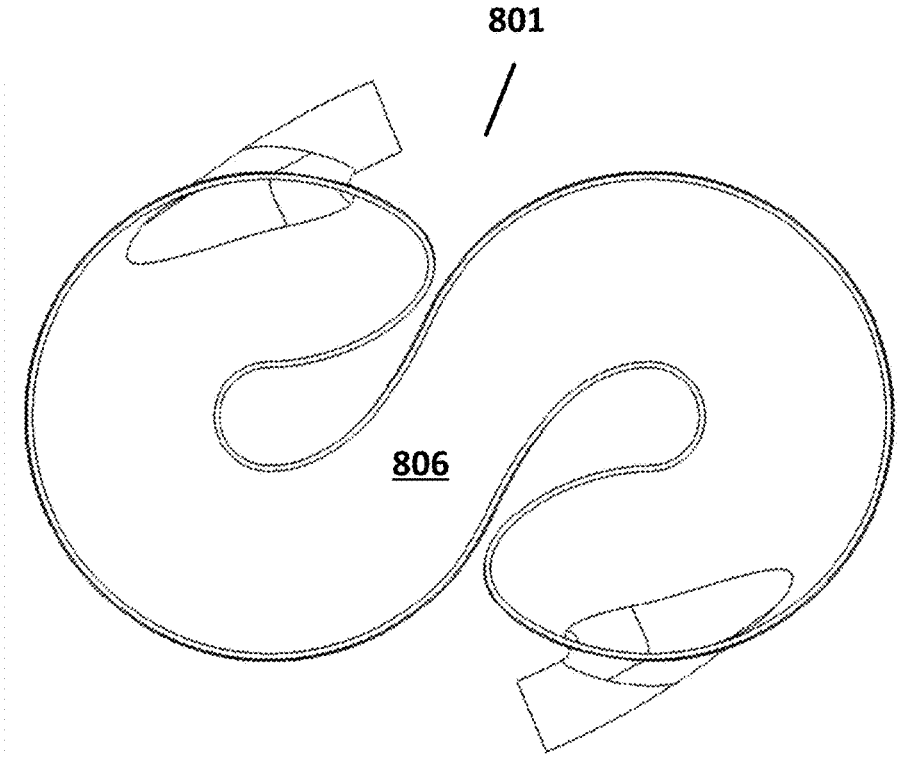
FIG. 8B

FIG. 9A
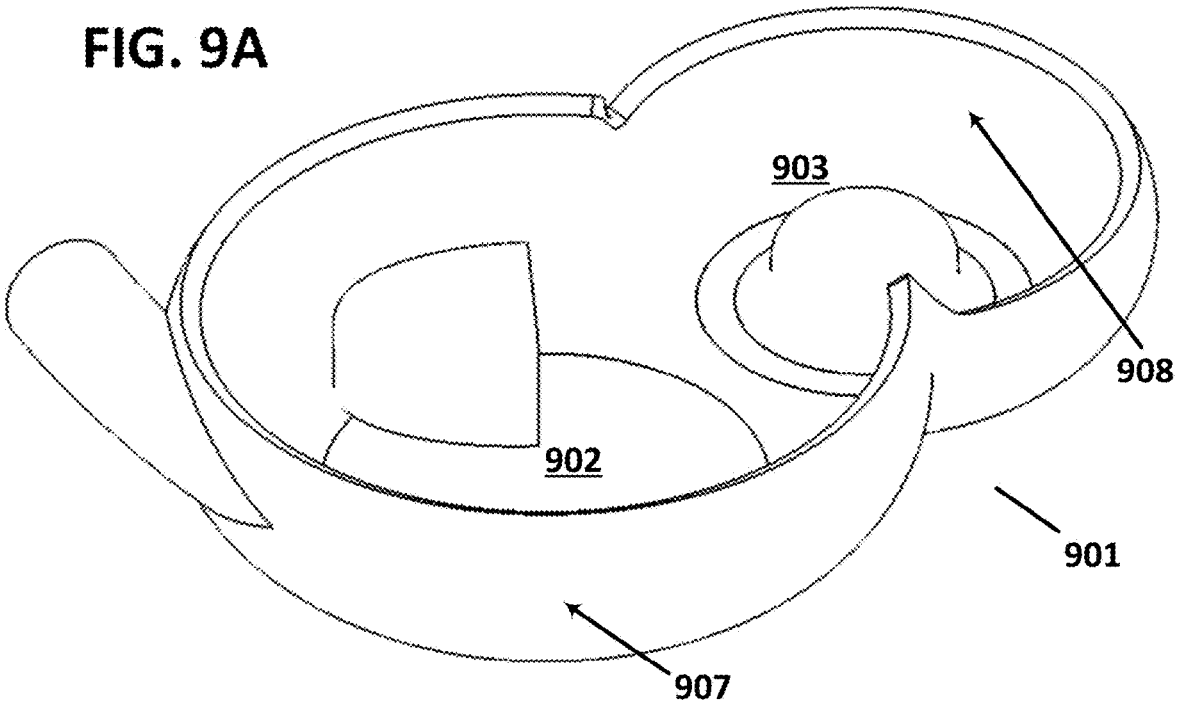
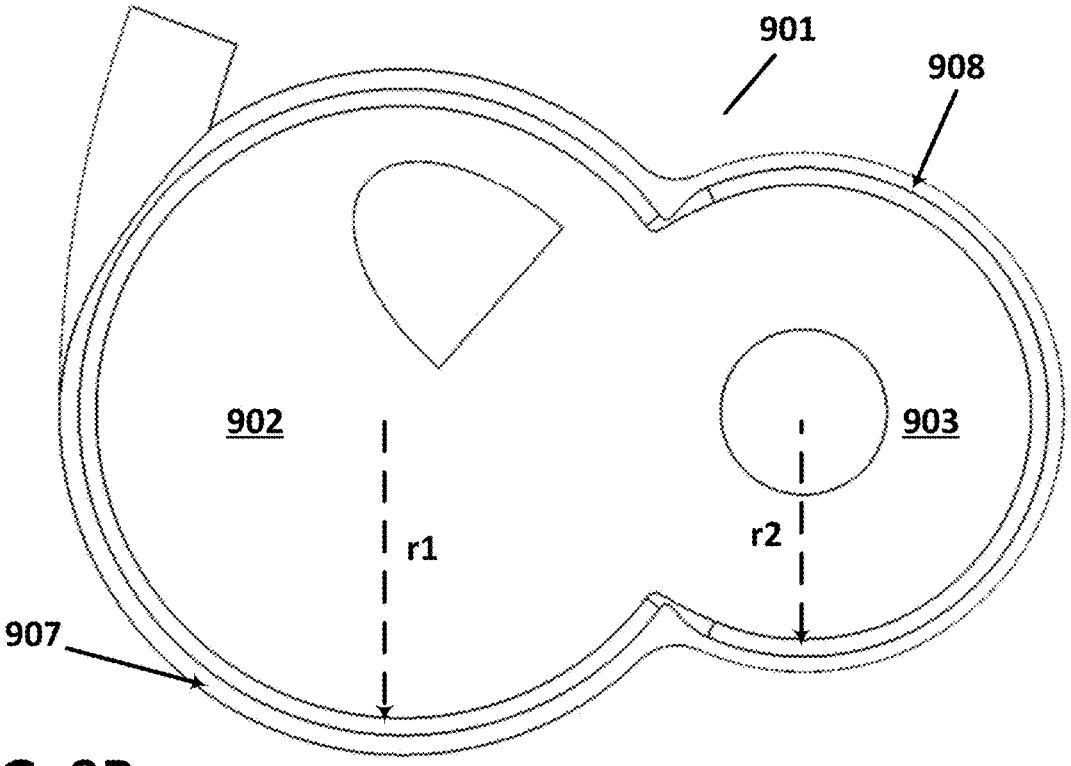
FIG. 9B

CONJOINED MULTIPLE BOWL WATER SLIDE FEATURE

CROSS REFERENCE TO RELATED APPLICATIONS

This application claims priority to U.S. provisional patent application Ser. No. 63/264,087, dated Nov. 15, 2021.

BACKGROUND

The Water Slide Bowl feature is a common feature in the water slide industry.

The existing water slide bowl experience is exciting when the ride vehicles first enter the bowl at speed and rider around it quickly. As their speed reduces, the ride vehicle's path decays as it slows towards the center. Ride vehicles then exit the bowl through an exit positioned at or near the center of the bowl. Therefore, ride vehicles enter through or adjacent an outer sidewall of the bowl, travel around the outside of the bowl and eventually exit the bowl through an opening in the center. The decay of the vehicle ride path is not consistent from cycle to cycle due to variances in total vehicle weight and weight distribution.

For amusement park operators, throughput consistency is important. However, the variances in ride path due to differences in weights and distribution, for a conventional bowl contributes to increased overall cycle time. The variability of ride path also leads to variability at the ride vehicle exit. However, variability in the exit positions may result in unstable exit situations. Therefore, although the bowl structure provides a unique and exciting ride experience, the ride does not improve all functional attributes desirable for amusement attractions.

The amusement water related industry is constantly seeking new ride experiences from the market to help with drawing new clients in and keeping their attractions attractive in their local market. Some competitors have tried to create a more defined constrained ride vehicle path within the bowl, such that the path is more determined. Existing solutions have only included a single bowl. There have also been industry efforts to add water jets into the bowls in an effort to provide more determinant slide paths.

Previous attempts to design a predetermined slide trajectory path removed the sense of slide path freedom associated with a normal bowl. Some others have tried to introduce two ride vehicles into the same bowl at the same time, with the ride vehicles sharing the same riding surface within a single bowl.

BRIEF SUMMARY OF THE INVENTION

Exemplary embodiments described herein relate to conjoining multiple curved features with a central crossover section that allows for a change in direction between the curved features. The same central crossover section may also be used with a second ride vehicle traveling in the opposite direction. The conjoined features may have the same or different curvatures.

These and other embodiments of the present invention will become apparent to those skilled in the art from a consideration of the following detailed description taken in combination with the accompanying drawings and by the elements, features, and combinations particularly pointed out in the claims.

BRIEF DESCRIPTION OF THE DRAWINGS

Exemplary embodiments will be described and explained with additional specifics and details through the use of the accompanying drawings.

FIGS. 8A and 8B illustrate an exemplary embodiment of the conjoined bowl feature with an s-shaped joining feature.

FIGS. 9A and 9B illustrate an exemplary embodiment of the conjoined bowl feature with one bowl larger than the other.

DETAILED DESCRIPTION OF THE INVENTION

Figure 1:
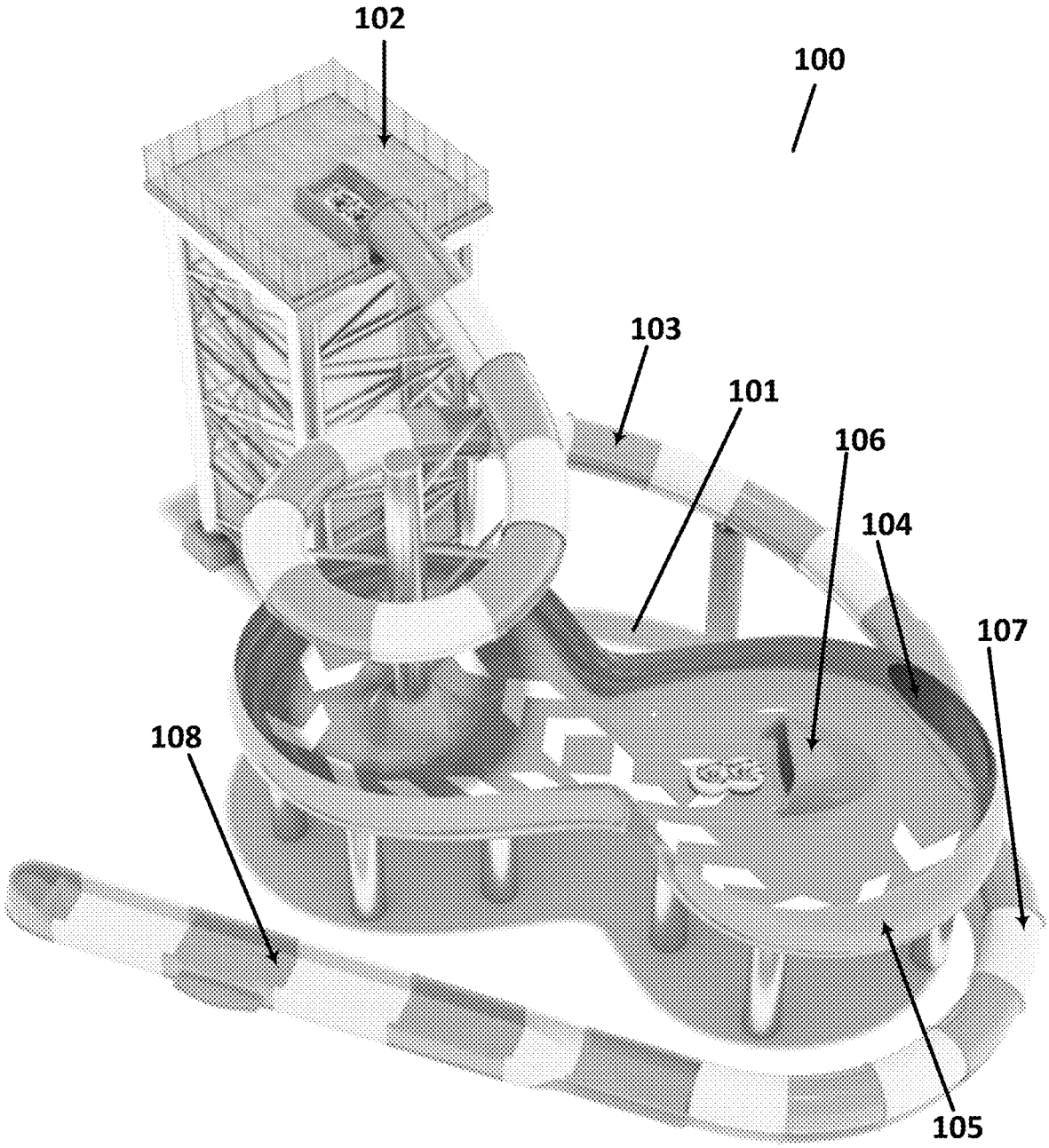
FIG. 1 illustrates an example ride configuration that incorporates an exemplary embodiment of a conjoined bowl feature.

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Exemplary embodiments described herein include at least two bowl structures that are conjoined. The bowl structures are configured such that a ride vehicle may ride around all or a portion of the bowl structure(s). Throughout this description, it should be understood that the term "ride vehicle" refers to a ride vehicle (e.g., a raft) carrying a single rider or multiple riders as is commonly used in the industry. It is also contemplated that a rider riding without a vehicle may enjoy the inventions described herein, notwithstanding the use of the term "vehicle" in the description.

Exemplary embodiments described herein may use multiple bowls. Ride vehicles can experience the existing part of bowls when riding the bowl walls and reduce the decay portion of existing rides. This invention creates a more consistent guest experience regardless of vehicle total weight or distribution.

Although embodiments of the invention may be described and illustrated herein in terms of bowl ride structures, it should be understood that embodiments of this invention include different open and enclosed surfaces that may include different combinations of curved (concave and/or convex) and/or planar portions. Exemplary embodiments may include concave surfaces, and/or surfaces having additional contours and/or path guidance features, such as for example, indentations, and/or projections and remain within the scope of the instant disclosure. As used throughout this description, references to a bowl structure are not intended to describe a structure with walls around the entire circumference of the bowl structure. Instead, when two bowl structures are joined together, as described below, the area where the two bowl structures meet may have little or no wall. Likewise, the bowl structure does not require that the bowl have a constant radius of curvature; rather the bowl structure may have portions that are more or less curved with respect to another section. In particular, in some embodiments, the bowl structure may include a bottom surface that is substantially planar along at least a portion of the structure.

Exemplary embodiments may comprise a conjoined bowl structure in which a ride vehicle rides about a peripheral edge of the first bowl structure, enters the second bowl structure, rides about a periphery of the second bowl structure, and exits at or near the periphery of the second bowl structure. Although exemplary embodiments described herein may not rely on the decay of ride vehicle speed and exit the bowl structure at a periphery of one of the bowl structures, embodiments are not so limited. Exemplary embodiments may therefore include the ride vehicle existing the second bowl structure near the center of the second bowl structure.

By not relying on decay of velocity to exit the bowl structure, cycle time may be more consistent regardless of variabilities in total vehicle weights or distribution. Consistent cycle time is desirable for throughput consistency. In addition, the concept can be applied using multiple entries into opposing bowls to allow for two vehicles into the bowls at the same time. This configuration further increases throughput and consistency. Exemplary embodiments described herein may improve the functionality of a ride and reduces some deficiencies of the existing common industry bowl feature. By creating a more consistent path and repeatability within the bowls, the exits may be more consistent and stable.

Exemplary embodiments described herein may include the combination of conjoined water slide features with changes in rotation. Exemplary embodiments are therefore unique and may serve to meet the demand for new innovative amusement water related ride experiences.

FIG. 1 illustrates an example ride configuration that incorporates one exemplary embodiment of a conjoined bowl feature.

FIG. 1 illustrates an exemplary embodiment of a ride (100) featuring an example configuration of the conjoined bowls feature (101). From the perspective of a rider in a ride vehicle, the conjoined bowls feature (101) may follow shortly after the entrance to the ride (102) via a first section of the ride (103), which deposits the ride vehicle into the conjoined bowl feature (101) via the bowl entrance (104). The ride vehicle may exit the conjoined bowls feature (101) via the bowl exit (106) into a subsequent section of the ride (107) before exiting the ride into a pool or shutdown lane (108).

In other embodiments of the ride, the conjoined bowl feature (101) may be entered directly from the ride entry (102), directly proceed and/or follow another conjoined bowl feature (101), exit directly into a pool or shutdown lane (108), and/or directly or indirectly proceed and/or follow another ride feature, such as an open or closed flume, another bowl feature, or any other suitable ride feature.

As shown in FIG. 1, the first section of the ride (103) proceeding the conjoined bowls feature (101) may be designed to have a steep gradient so that the speed of the ride vehicle before entering the conjoined bowl feature (101) is great enough to pin the ride vehicle up against the ride surface wall (105) as the ride vehicle enters the conjoined bowls feature (101) at the bowl entrance (104). In another embodiment the speed of the ride vehicle may be increased before entering the conjoined bowls feature (101) via other methods such as water or air nozzles, magnets, sprung or driven mechanical pushing aids. The arrows shown in the conjoined bowl feature (101) in FIG. 1 depict an exemplary slide path that the ride vehicle might take from the conjoined bowl feature entrance (104) to the exit. In another embodiment, the first section of the ride (103) proceeding the conjoined bowls feature (101) may be designed to have a shallow gradient so that the speed of the ride vehicle entering the conjoined bowl feature (101) can be relatively slow.

Figure 2A:
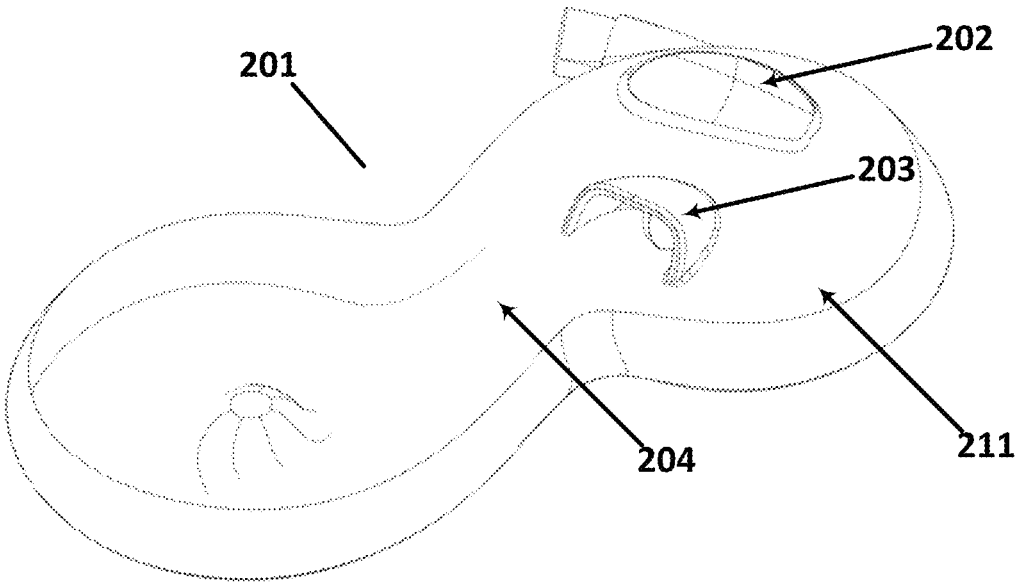
FIGS. 2A and 2B illustrate an exemplary embodiment of the conjoined bowl feature with a common crossover area and an entrance and exit within the same side of the conjoined bowl.

FIG. 2A is a perspective view of an exemplary embodiment of the conjoined bowl feature (201) with a common crossover area (204) and an entrance (202) and exit (203) within the same bowl (211) of the conjoined bowl. It is contemplated that the exemplary embodiment (201) shown in FIG. 2A (and similar alternative embodiments) may be used in place of the conjoined bowl feature (101) depicted in FIG. 1 or in alternative ride configurations.

Figure 2B:
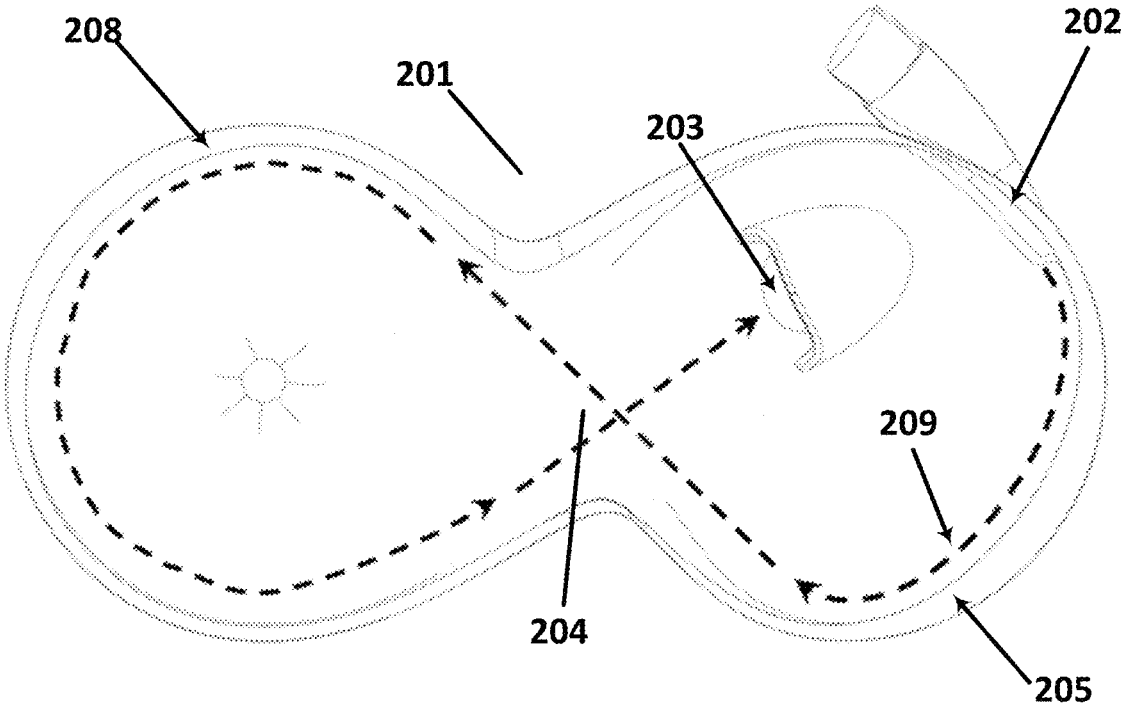

FIG. 2B is an overhead view of the conjoined bowl feature (201) show in FIG. 2A, further showing an exemplary ride vehicle path (209) through the conjoined bowl feature (201), the ride vehicle path (209) approximately follows a figure "8". The ride vehicle enters the conjoined bowl feature (201) at the entrance (202), and rides around the first bowl wall (205), the ride vehicle then transitions down the first bowl wall (205) before the riding through the crossover area (204) for the first time. The ride vehicle then climbs the second bowl wall (208) and rides around the second bowl wall (208). The ride vehicle then transitions down the second bowl wall (208) before riding through the crossover area (204) for the second time. Finally the ride vehicle exits the conjoined bowl feature (201) via the exit (203). As depicted in FIGS. 2A and 2B, the exit (203) is at least partially covered to prevent ride vehicles from exiting the bowl feature prematurely, and to further direct the flow of water and the ride vehicle along the preferred ride path (209). In alternative embodiments, the exit (203) may be uncovered, or may take a different shape as described herein.

The invention may be configured in either single ride vehicle, or multiple ride vehicle embodiments. For the single vehicle embodiment, one possible configuration is shown in FIG. 2, which illustrates a water slide configuration 100 having a conjoined bowl feature (201) with a first bowl structure conjoined with a second bowl structure. In this configuration, ride vehicles enter into the first feature at the ride vehicle entrance (202). This location may be located along any portion of the perimeter of the first bowl feature. The ride vehicle then rides around the bowl as they travel along the outside bowl perimeter wall (205), shaped either as a substantially circular cross section, or ellipsoidal shape. The ride vehicle transfers from the first bowl to the second bowl at location the crossover point (204). This is accomplished by transitioning the ride vehicle from a wall rotation and onto a flat section or shallow curved section. The shape of the perimeter wall changes at this location to allow the ride vehicle to transfer from the bowl cross section into a generally flat section to translate into the second bowl. The ride vehicle rides in the opposite direction around the second bowl perimeter (208) along path (209). The ride vehicle is directed at the exit of the second bowl back across the flat transfer plane, across the crossover point (204) once more, into an exit (203), where the ride vehicle drops into an exit flume (not shown). As depicted in FIG. 1, the exit flume at exit (203) may be wide and drop down and cross underneath the first ride feature. Alternatively, the exit flume could be arranged to go in a different direction so that it does not cross under another section of the ride. The exit (106/203) may be sufficiently wide to allow for a wider spectrum of input trajectories.

Figure 3A:
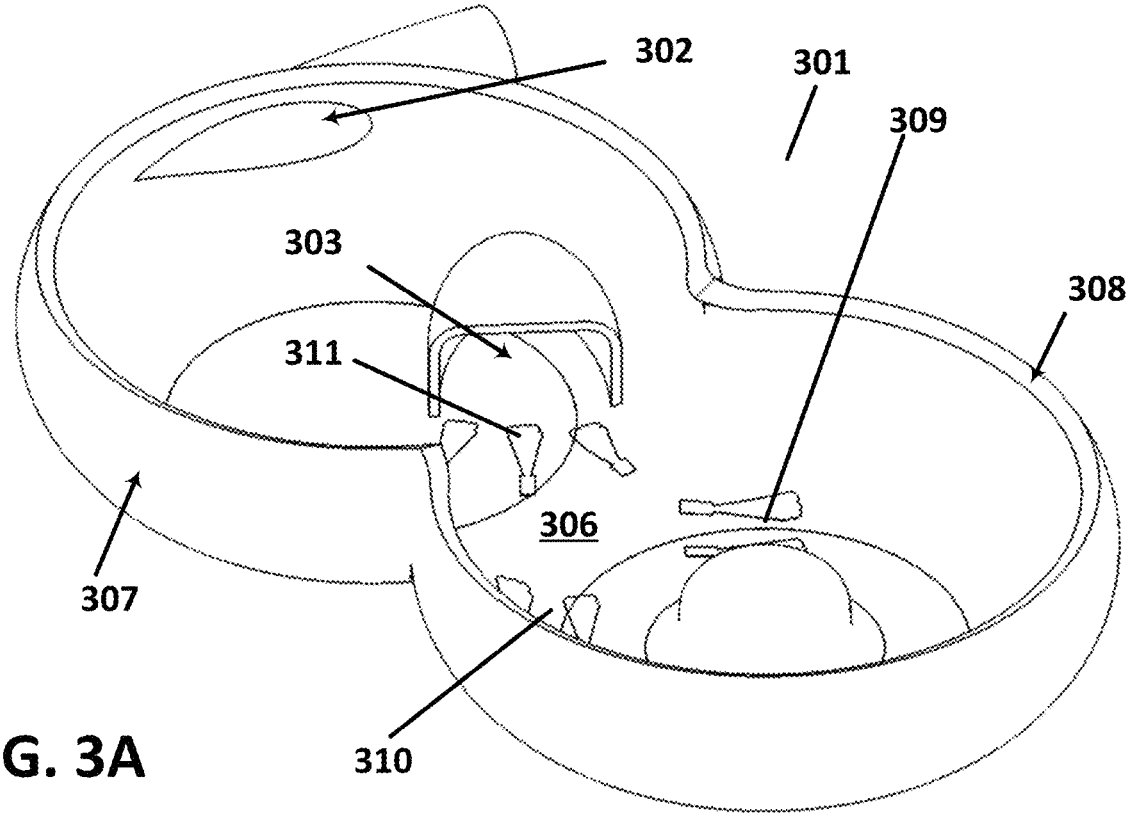
FIGS. 3A and 3B illustrate an exemplary embodiment of the conjoined bowl feature with water nozzles used to push the ride vehicle around the second wall surface and towards the exit feature.
Figure 3B:
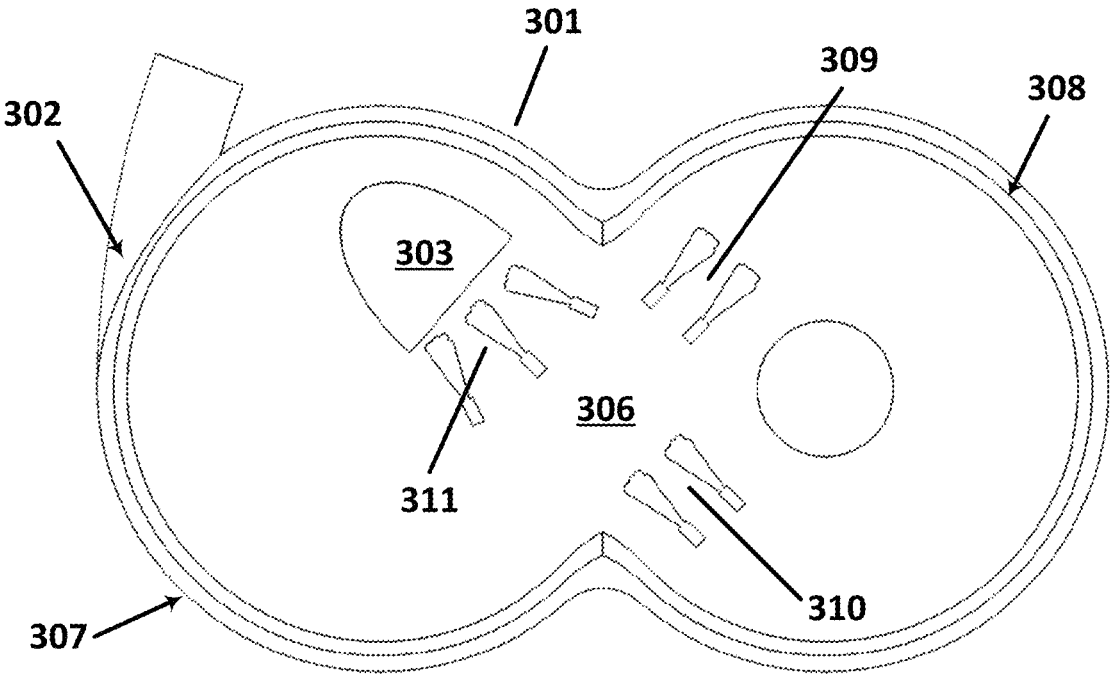

FIG. 3A is a perspective view of an exemplary embodiment of the conjoined bowl feature (301) with water nozzles (309, 310, and 311) that shoot jets of water to push the ride vehicle around the second wall surface (305) and towards the exit (303). Preferably, the nozzles (309, 310, and 311) will be installed flush with or below the surface of the conjoined bowl feature, so that the nozzle structure will not interfere with, redirect, or hamper the path of the ride vehicle. FIG. 3A is a representation of the nozzles that may exaggerate the size of the nozzles. It is contemplated that the exemplary embodiment (301) shown in FIG. 3A (and similar alternative embodiments) may be used in place of the conjoined bowl feature (101) depicted in FIG. 1 or in alternative ride configurations. As depicted in FIGS. 3A and 3B, the water nozzles (309/310/311) are depicted in groups of two or three. In practice, the water nozzle may be a single nozzle, or multiple nozzles, as best fits the particular needs of the ride.

FIG. 3B is an overhead view of the exemplary configuration of nozzle groups (309, 310, and 311) in the conjoined bowl feature (301) depicted in FIG. 3A. In the illustrated embodiment the ride vehicle enters the conjoined bowl feature (301) at the entrance (302), the ride vehicle then rides around the first bowl wall (307) before riding through the crossover area (306). The ride vehicle speed is then increased by the first group of nozzles (309) before or as the ride vehicle rides around the second bowl wall (308). The ride vehicle speed is then increased again by a second group of nozzles (310) before or as the ride vehicle rides through the crossover area (306). The ride vehicle speed is then increased again by the third group of nozzles (311) before or as the ride vehicle exits the conjoined bowl feature (301) via the exit (303). In another embodiment one or more of the nozzle groups (309, 310, and 311) may shoot a jet of water opposite the direction of travel of the ride vehicle in order to slow down or maintain the speed of the ride vehicle. In another embodiment one or more of the nozzle groups (309, 310, and 311) may shoot a jet of water to push the ride vehicle in a certain direction e.g. towards the exit (303).

FIGS. 3A-3B illustrate an exemplary configuration of nozzle groups (309, 310, and 311) in the conjoined bowl feature (301). Each group of nozzles (309, 310, and 311) may contain one or more nozzle. In an exemplary embodiment the water flow volume through the nozzles (309, 310, and 311) may be electronically controlled using variable frequency drives (VFDs) or similar technology used to control the drive speed of the nozzle water pumps. In another embodiment the water flow volume through the nozzles (309, 310, and 311) may be controlled by maintaining a constant drive speed to the nozzle water pumps and using mechanical systems, for example ball valves, butterfly valves or similar technology, to restrict the water flow volume getting to the nozzles (309, 310, and 311). In another embodiment the water flow volume through the nozzles (309, 310, and 311) may be controlled by using a combination of electronic and mechanical speed control systems.

Figure 4A:
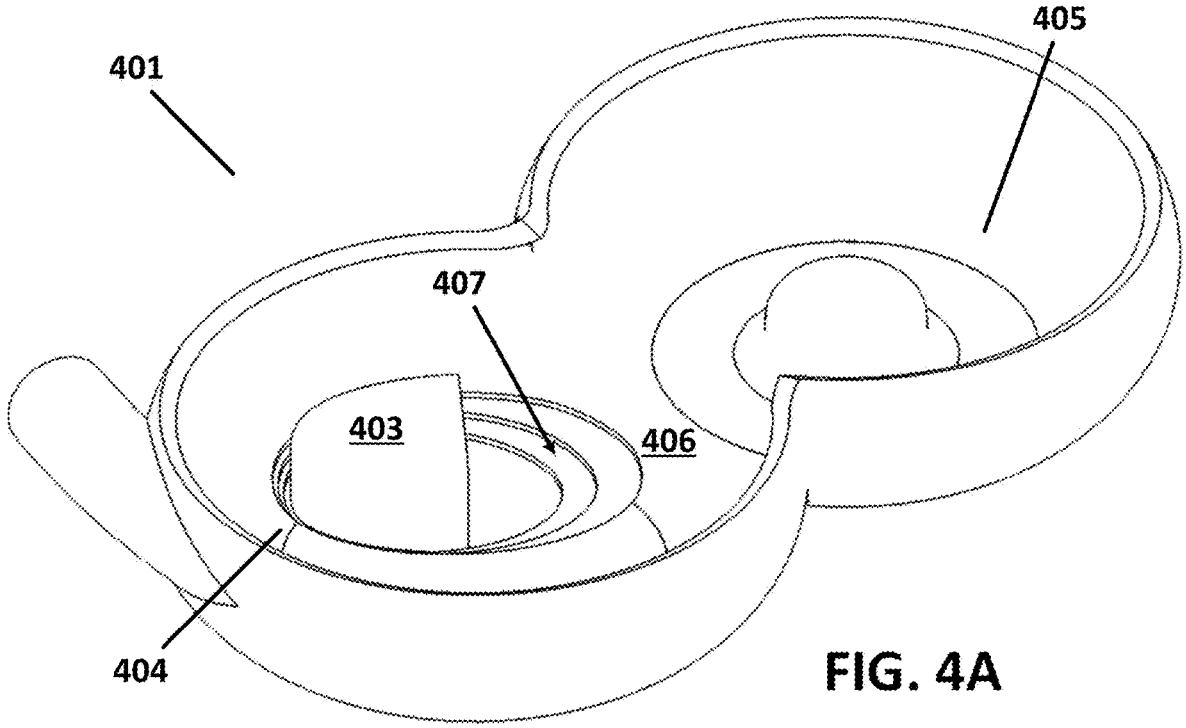
FIGS. 4A and 4B illustrate an exemplary embodiment of the conjoined bowl feature with a sunken exit area to assist ride vehicles towards the exit of the feature using gravity.

FIG. 4A is a perspective view of an exemplary embodiment (401) of the conjoined bowl feature with a recessed or sunken exit area (407) to assist ride vehicles towards the exit of the feature using geometry and gravity. It is contemplated that the exemplary embodiment (401) shown in FIG. 4A (and similar alternative embodiments) may be used in place of the conjoined bowl feature (101) depicted in FIG. 1 or in alternative ride configurations.

Figure 4B:
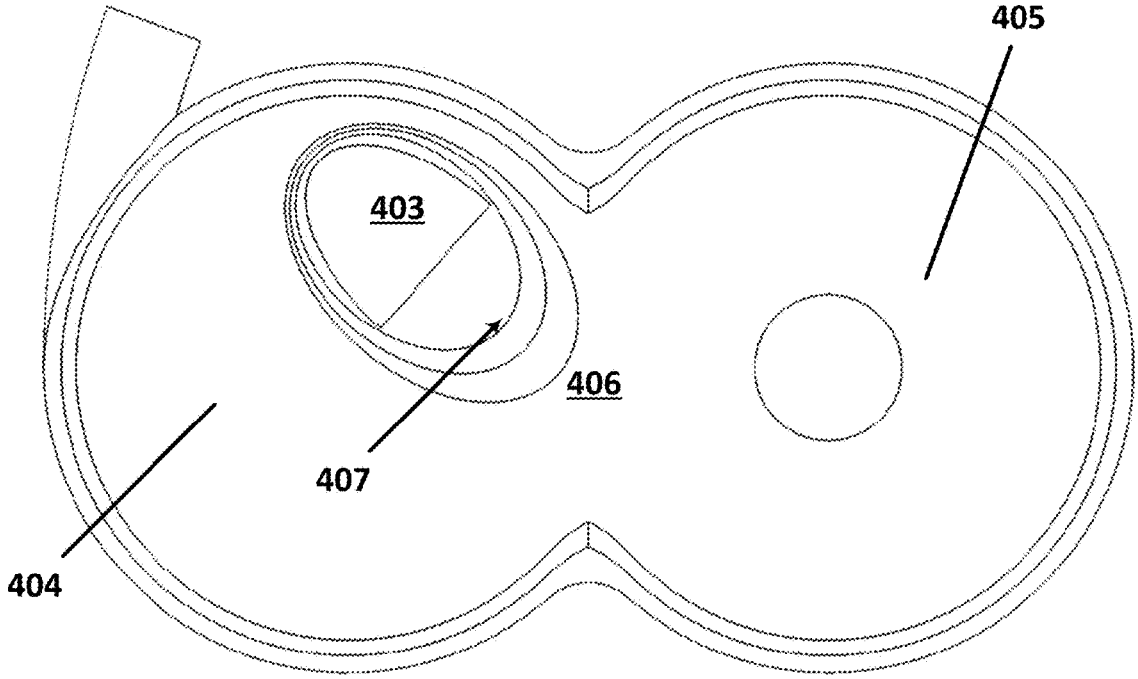

FIG. 4B illustrates an overhead view of the exemplary embodiment of the conjoined bowl feature (401) with the sunken exit area (407) depicted in FIG. 4A. The sunken exit area is useful in the event the ride vehicle slows within the first bowl (404) or near the crossover area (406). In that event, the geometry of the sunken exit area (407) is designed so that the ride vehicle will be funneled towards the exit (403) with the assistance of gravity. In another embodiment the geometry within the second bowl (405) may also be inclined toward the first bowl to funnel a slow ride vehicle towards the sunken exit area (407) and into the exit (403). In another embodiment geometry funneling may be used alongside one or more nozzles (such as elements 309, 310, and 311 illustrated in FIGS. 3A and 3B) to funnel a slow ride vehicle towards the exit (403).

Figure 5A:
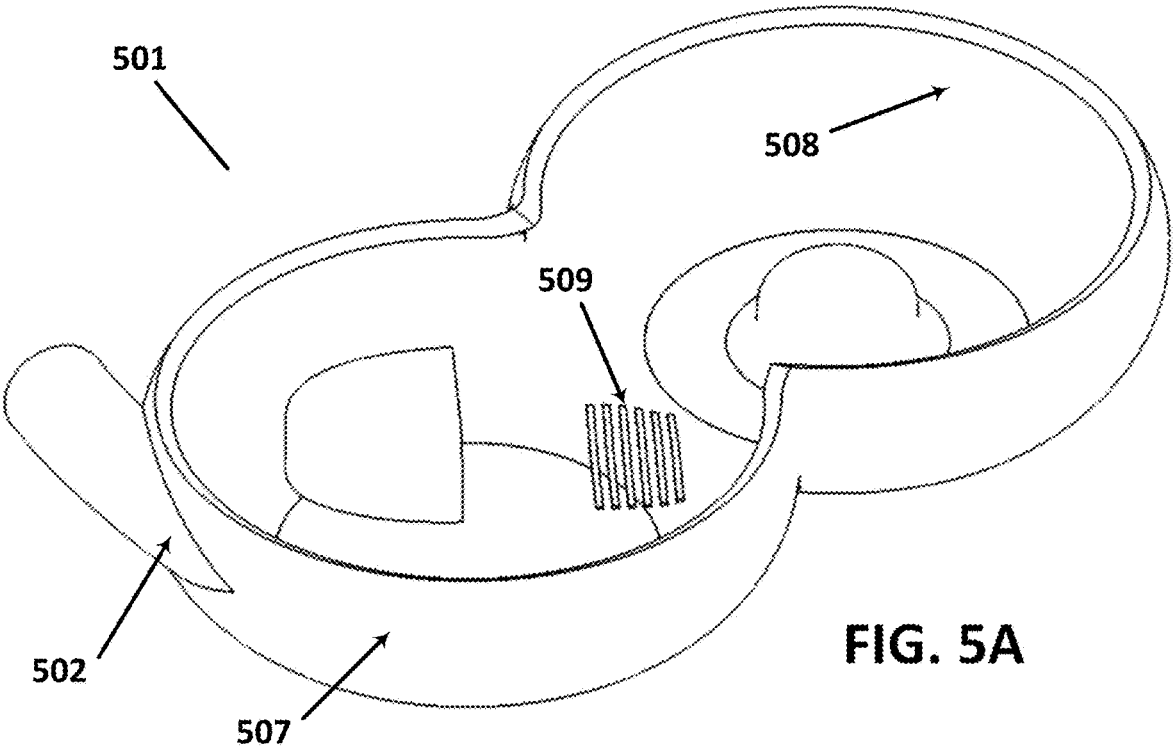
FIGS. 5A and 5B illustrate an exemplary embodiment of the conjoined bowl feature with channels in the ride surface at the crossover area.

FIG. 5A is a perspective view of an exemplary embodiment of the conjoined bowl feature (501) with channels (509) in the ride surface at the crossover area (506). It is contemplated that the exemplary embodiment (501) shown in FIG. 5A (and similar alternative embodiments) may be used in place of the conjoined bowl feature (101) depicted in FIG. 1 or in alternative ride configurations.

Figure 5B:
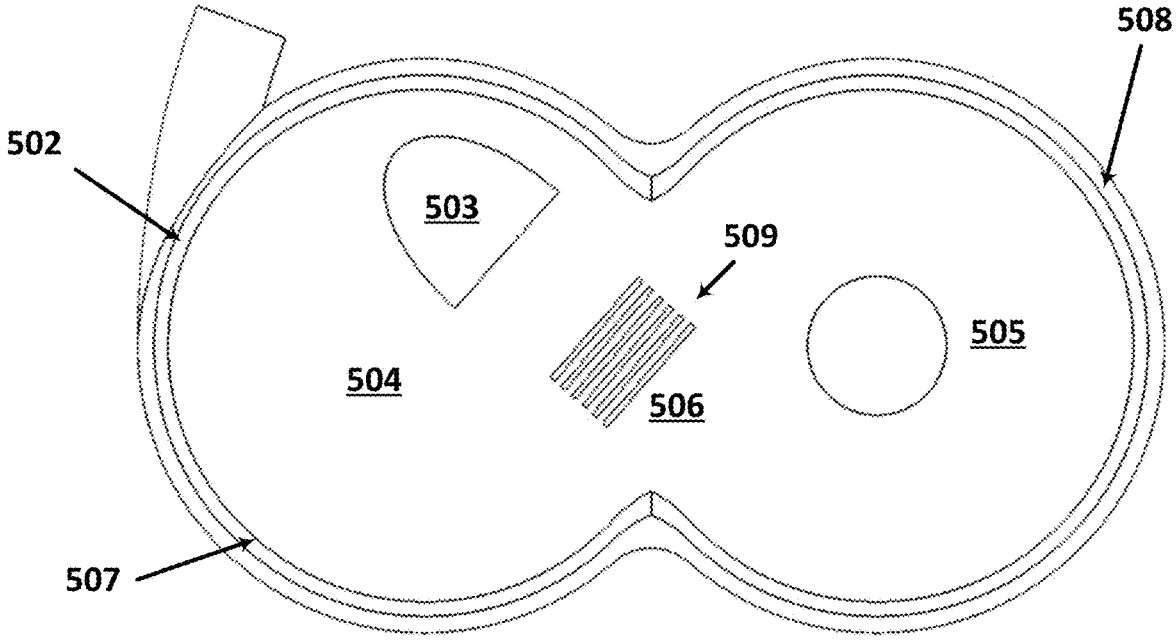

The channels (509) illustrated in FIGS. 5A and 5B are designed to not adversely affect the ride vehicle speed when the ride vehicle is travelling approximately parallel to the long direction of the channels (509). In a preferred embodiment, the channels are formed of multiple raised ridges spaced apart from each other. As the ride vehicle in the conjoined bowl feature (501) travels approximately parallel to the long direction of the channels (509), there is little or no disruption to the direction and speed of the ride vehicle as the vehicle rides along the raised ridges above any pooled water in the crossover area (506). The channels (509) are also designed to slow the ride vehicle speed when the ride vehicle is travelling approximately perpendicular to the long direction of the channels, similar to how speed bumps work. Each group of channels (509) may contain one or more channel.

FIG. 5B illustrates an overhead view of the exemplary embodiment of the conjoined bowl feature (501) with channels (509) depicted in FIG. 5A. In the illustrated embodiment the ride vehicle enters the conjoined bowl feature (501) at the entrance (502), the ride vehicle then rides around the first bowl wall (507) before riding approximately parallel along the length of the channels (509) through the crossover area (506). The ride vehicle then rides around the second bowl wall (508) before riding approximately perpendicular to the length of the channels (509) through the crossover area. The ride vehicle speed is now slowed due to the channels (509) before finally exiting the conjoined bowl feature (501) via the exit (503).

In another embodiment the channels (509) may be oriented opposite to how the channels are depicted in FIGS. 5A and 5B. In this embodiment, the ride vehicle rides around the first bowl wall (507) and then encounters channels (509) whose longest direction is perpendicular to the ride vehicle in the crossover area. The ride vehicle speed is now slowed before riding around the second bowl wall (508). The ride vehicle then rides approximately parallel to the channels (509) whilst crossing the crossover area for the second time without adversely affect the speed of the ride vehicle before the exit (503).

In another embodiment two or more channel groups may be oriented to slow the ride vehicle during both crossings (i.e. from the first bowl (504) to the second bowl (505) and from the second bowl (505) to the exit (503)), such as in a cross-hatch orientation, thereby creating turbulence in the water in the crossover area.

In another embodiment one or more channels may be positioned at a different location within the conjoined bowl feature (501) that is not in the crossover area (506). For example, the channels may be located on the first bowl wall (507) or second bowl wall (508) to slow the ride vehicle, as necessary for the particular ride.

In another embodiment, the channels may be formed of grooves sunk into the surface of the conjoined bowl feature (501), rather than ridges above the surface. In this embodiment, the channels would preferably be formed such that the long dimension of the channels run toward the exit (503), thereby assisting the water within the conjoined bowl feature to flow toward the exit (503) rather than pooling in the crossover area (506).

Figure 6A:
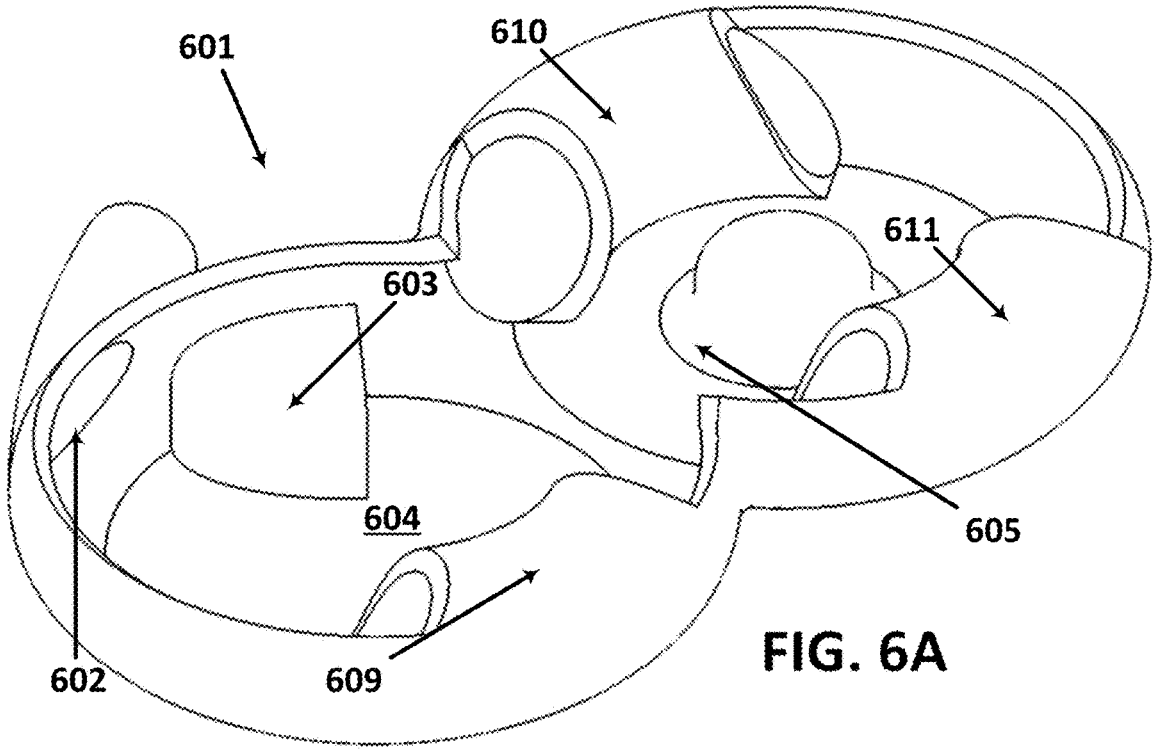
FIGS. 6A and 6B illustrate an exemplary embodiment of the conjoined bowl feature with open and covered areas of the feature.
Figure 6B:
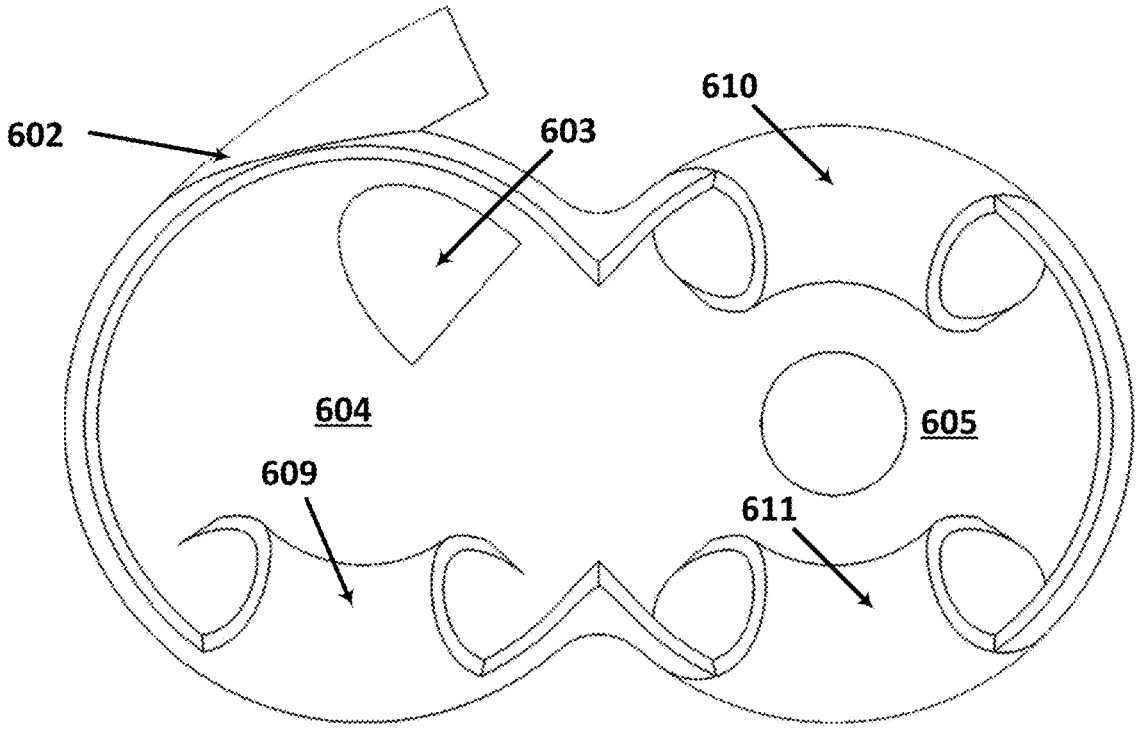

FIG. 6A is a perspective view of an exemplary embodiment (601) of the conjoined bowl feature with open and covered areas (609, 610 and 611) of the feature. FIG. 6B is an overhead view of the exemplary embodiment (601) of the conjoined bowl feature with open and covered areas (609, 610 and 611) depicted in FIG. 6A. It is contemplated that the exemplary embodiment (601) shown in FIG. 6A (and similar alternative embodiments) may be used in place of the conjoined bowl feature (101) depicted in FIG. 1 or in alternative ride configurations.

The covered areas (609, 610 and 611) illustrated in FIGS. 6A and 6B are designed to create an alternative rider experience, with the ride vehicle transitioning between open and expansive areas, and covered and enclosed sections (609, 610 and 611) of the conjoined bowl feature (601). In the illustrated embodiment in FIGS. 6A and 6B there are three covered sections (609, 610 and 611) and the crossover area (606) is open. In other embodiments there may be only one covered area in the conjoined bowl feature (601), or there may be two, three, four, or any number of covered areas as may be preferred.

In another embodiment the crossover area (606) may be covered. For example, the portion between covered area (609) and covered area (610) may be entirely covered and the area between covered area (611) and the exit may be covered. In this embodiment, the covered area may thus form an "X" shape in the crossover area, or the covered area may be shaped in a square, circle, or any suitable shape.

In another embodiment the entire conjoined bowl feature (601) may be covered. In another embodiment only one bowl of the conjoined bowl feature may be covered, for example the second bowl of the conjoined feature (605). In the embodiment where only one bowl (i.e., 604 or 605) of the conjoined bowl (601) is covered, the covering may extend over the entire bowl of the conjoined bowl such that approximately one half of the conjoined bowl is open and the other half is covered. In another embodiment, the entrance (602) or exit (603) of the conjoined bowl feature (601) may be connected to one of the covered areas. For example, the covered area (609) in the first bowl (604) of FIG. 6B may be connected to the entrance (602) to create one long covered feature. Or, in an embodiment where the exit is in the second bowl (605) (for example, as depicted in FIG. 7B), covered area 610 might extend all the way to the exit feature.

Figure 7A:
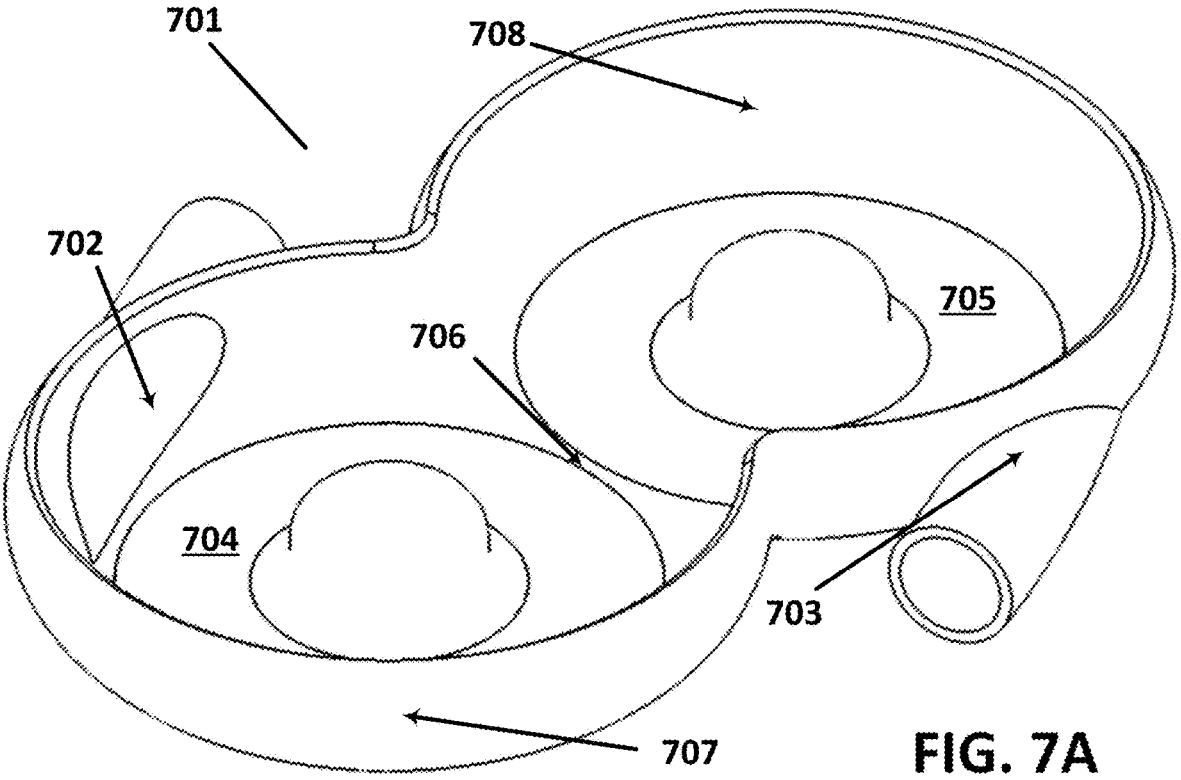
FIGS. 7A and 7B illustrate an exemplary embodiment of the conjoined bowl feature with an entrance and exit in opposite sides of the conjoined bowl feature.

FIG. 7A is a perspective view of an exemplary embodiment of the conjoined bowl feature with an entrance (702) and exit (703) in opposite sides or opposite bowls of the conjoined bowl feature. FIG. 7B is an overhead view of the exemplary embodiment (701) of the conjoined bowl feature depicted in FIG. 7A. It is contemplated that the exemplary embodiment (701) shown in FIGS. 7A and 7B (and similar alternative embodiments) may be used in place of the conjoined bowl feature (101) depicted in FIG. 1 or in alternative ride configurations.

Figure 7B:
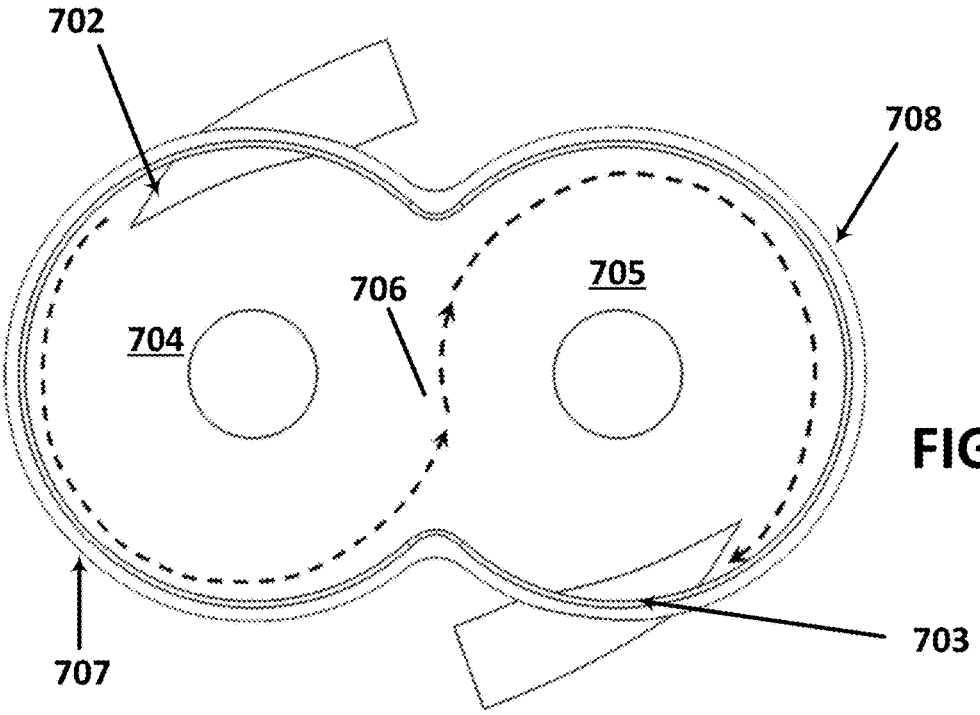

As depicted by the dashed line in FIG. 7B an exemplary ride path through the conjoined bowl feature (701) approximately follows a "S" shape. The ride vehicle enters the first bowl (704) at the entrance (702), the ride vehicle rides around the first bowl wall (707), the ride vehicle then transitions down the first bowl wall (707) before crossing the conjoined area (706). The ride vehicle then rides around the second bowl wall (708), finally the ride vehicle exits the second bowl (705) via the exit (703).

FIG. 8A is a perspective view of an exemplary embodiment (801) of the conjoined bowl feature. FIG. 8B is an overhead view of the exemplary embodiment (801) of the conjoined bowl feature depicted in FIG. 8A. It is contemplated that the exemplary embodiment (801) shown in FIGS. 8A and 8B (and similar alternative embodiments) may be used in place of the conjoined bowl feature (101) depicted in FIG. 1 or in alternative ride configurations.

Similar to FIGS. 7A and 7B above, the illustrated embodiment (801) in FIGS. 8A and 8B illustrate the ride vehicle path approximately follows a "S" shape, however the conjoined area (706 in FIGS. 7*a* and 7*b*) is replaced with an s-shaped joining feature (806).

FIG. 9A is a perspective view of an exemplary embodiment (901) of the conjoined bowl feature with one bowl (902) larger than the other bowl (903). FIG. 9B is an overhead view of the exemplary embodiment (901) of the conjoined bowl feature depicted in FIG. 9A. It is contemplated that the exemplary embodiment (901) shown in FIGS. 9A and 9B (and similar alternative embodiments) may be used in place of the conjoined bowl feature (101) depicted in FIG. 1 or in alternative ride configurations.

As illustrated in FIGS. 9A and 9B, as the radius (r2) of the second bowl (903) is less than the radius (r1) of the first bowl (902) the centripetal force on the ride vehicle is greater on the smaller second bowl wall (908) compared to the first bowl wall (907) for a ride vehicle travelling at the same speed. In reality the speed will decay due to friction; in this embodiment (901) the radius difference between the first bowl (904) and the second bowl (905) is designed so that the centripetal force on the ride vehicle is greater at the start of the smaller bowl wall (908) compared to the end of the first bowl wall (907).

In another embodiment, the orientation of the bowls may be reversed, such that the first bowl has a smaller radius and the second bowl has a larger radius. This arrangement may be useful to quickly decrease the centripetal force on the ride vehicle when riding the second larger bowl wall when compared to the first smaller bowl wall.

Figure 10A:
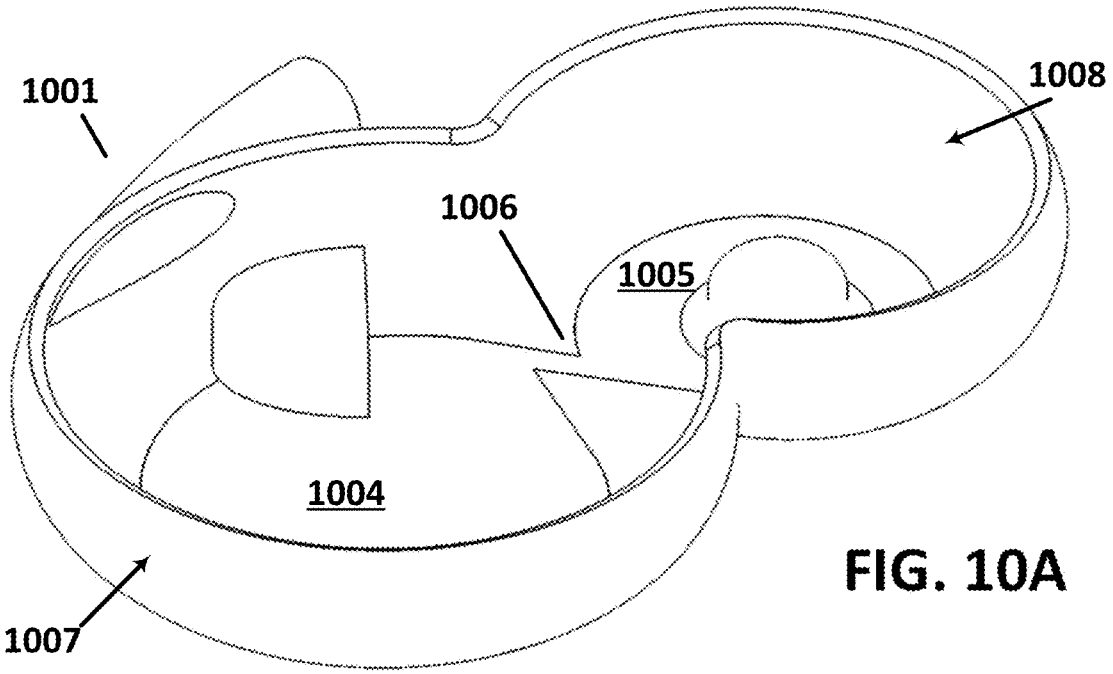
FIGS. 10A and 10B illustrate an exemplary embodiment of the conjoined bowl feature in which both bowls have continually decreasing radii.
Figure 10B:
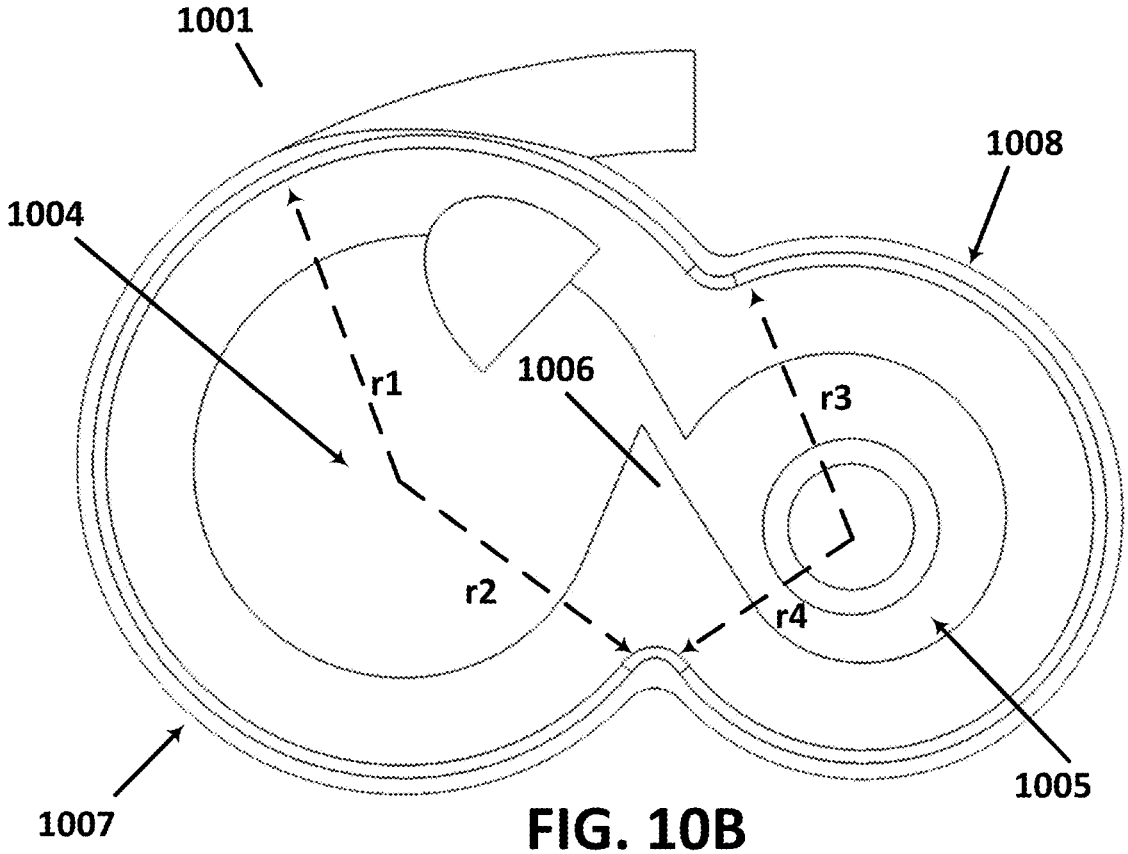

FIG. 10A is a perspective view of an exemplary embodiment (1001) of the conjoined bowl feature with continually decreasing radius along the bowl walls (1007 and 1008). FIG. 10B is an overhead view of the exemplary embodiment (1001) of the conjoined bowl feature depicted in FIG. 10A. It is contemplated that the exemplary embodiment (1001) shown in FIGS. 10A and 10B (and similar alternative embodiments) may be used in place of the conjoined bowl feature (101) depicted in FIG. 1 or in alternative ride configurations.

As best seen in the overhead view in FIG. 10B, the radius (r1) at the entrance (1002) of the first bowl (1004) is the largest radius, the radius then continually decreases such that the radius (r2) at the end of the first bowl before the crossover area (1006) is smaller than r1. The radius (r3) at start of the second bowl (1005) is then less than radius (r2) at the end of the first bowl (1004). The second bowl radius continually decreases before reaching back to the crossover area (1006) such that the radius (r4) at the end of the second bowl is smaller than r3. As described above with respect to FIGS. 9A and 9B (and disregarding the effects of friction), for a ride vehicle travelling at the same speed, as the radius decreases the centripetal force will increase.

In this exemplary embodiment (1001) the radius decreases throughout the first bowl (1004) and the second bowl (1005) may be designed to maintain the centripetal force on the ride vehicle whilst on the bowl walls (1007 and 1008).

In another embodiment (not shown in the figures) the radius around the first bowl wall (1007) and the second bowl wall (1008) may continually increase to rapidly reduce the centripetal force on the ride vehicle.

In another embodiment (not shown in the figures) the radius around the first bowl wall (1007) may continually decrease and the radius around the second bowl wall (1008) may continually increase, first speeding the ride vehicle up in the first bowl, then slowing the ride vehicle in the second bowl. In another embodiment (not shown in the figures) the radius around the first bowl wall (1007) may continually increase and the radius around the second bowl wall (1008) may continually decrease, first slowing the ride vehicle in the first bowl, then speeding the ride vehicle up in the second bowl.

Figure 11A:
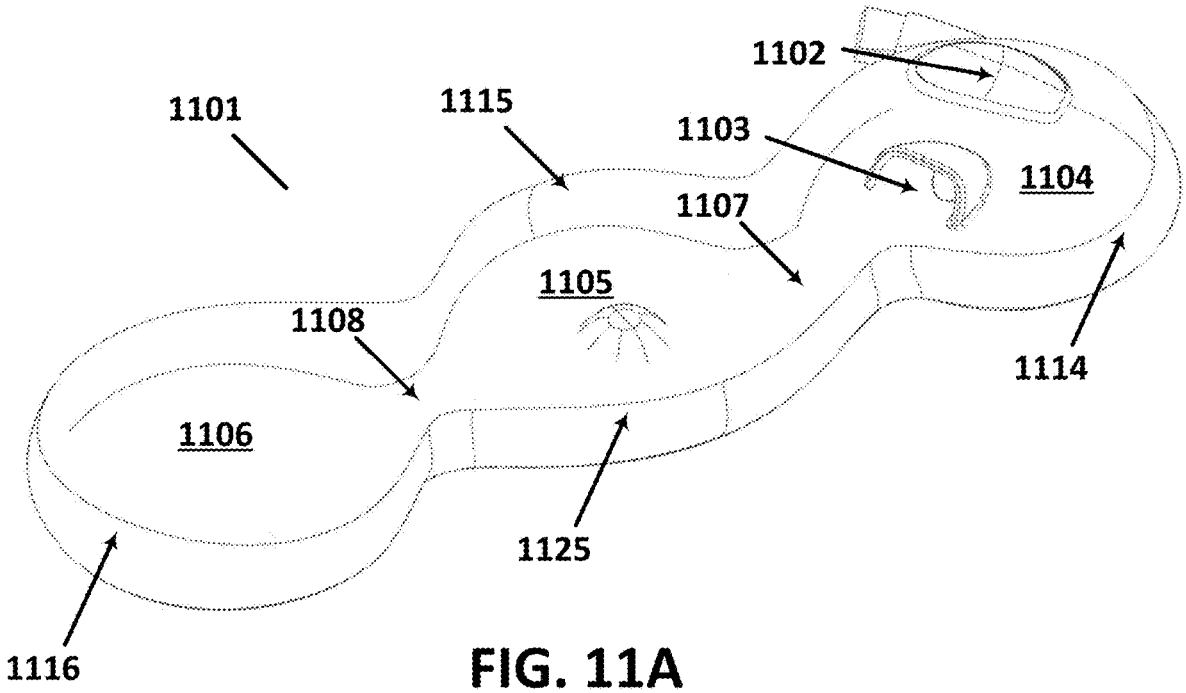
FIGS. 11A and 11B illustrate an exemplary embodiment of the conjoined bowl feature with three conjoined bowls, two common crossover areas, and an entrance and exit within the first bowl.
Figure 11B:
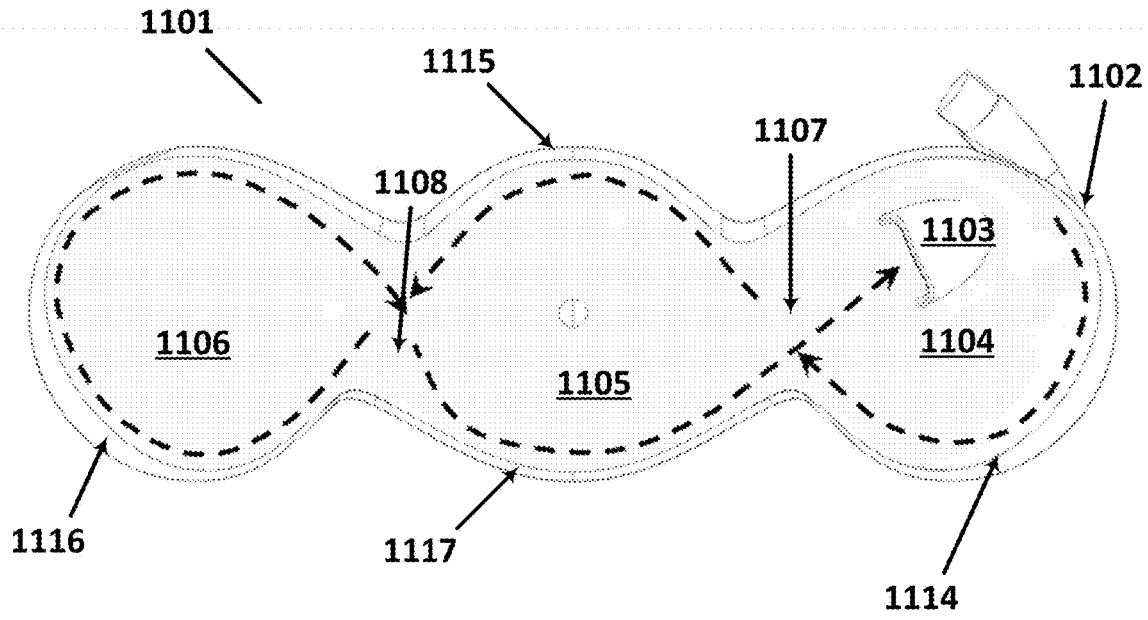

FIG. 11A is a perspective view of an exemplary embodiment (1101) of the conjoined bowl feature with three conjoined bowls (1104, 1105 and 1106), two common crossover areas (1107 and 1108) and an entrance (1102) and exit (1103) within the first bowl (1104). FIG. 11B is an overhead view of the exemplary embodiment (1101) of the conjoined bowl feature depicted in FIG. 11A. It is contemplated that the exemplary embodiment (1101) shown in FIGS. 11A and 11B (and similar alternative embodiments) may be used in place of the conjoined bowl feature (101) depicted in FIG. 1 or in alternative ride configurations.

As best seen in the overhead view in FIG. 11B, this embodiment has an exemplary ride vehicle path (indicated by the dashed line) through the conjoined bowl feature (1101), traversing all three conjoined bowls throughout the ride. The ride vehicle enters the conjoined bowl feature (1101) at the entrance (1102). The ride vehicle then rides around the first bowl wall (1114) before riding through the first crossover area (1107) for the first time, the ride vehicle then rides around the one of the second bowl walls (1115) before riding through the second crossover area (1108) for the first time. The ride vehicle then rides around the third bowl wall (1116) before riding through the second crossover area (1108) for the second time, the ride vehicle then rides around the second of the second bowl walls (1117) before riding through the first crossover area (1107) for the second time, finally the ride vehicle exits the conjoined bowl feature (1101) via the exit (1103).

In another embodiment of the conjoined bowl feature (1101) the entrance (1102) may deposit the ride vehicle directly into either the second bowl (1105) or third bowl (1106). For example, when the entrance deposits the ride vehicle directly into the second bowl, the entrance may be along wall (1115), such that the ride vehicle starts at the second bowl (1105) of the conjoined bowl feature (1101) and makes a circuit around the first bowl (1104), the rest of the second bowl (1105), and third bowl (1106) before exiting the feature (1101) through exit (1103) situated in the middle bowl (1105). In this embodiment the ride vehicle would be moving opposite direction of the directional arrows shown FIG. 11B. Alternatively, the entrance could be situated at the second bowl (1105) along the top wall (1115), but pointing toward third bowl (1106), or the entrance could be situated at the second bowl (1105) along the bottom wall (1117). In another embodiment of the conjoined bowl feature (1101) the exit (1103) may be within either the first bowl (1104) or third bowl (1106). It should be understood that the entrance and the exit may be placed in any of the multiple bowls such that the ride vehicle rides at least a portion of each of the multiple conjoined bowls before entering the feature.

Figure 11C:
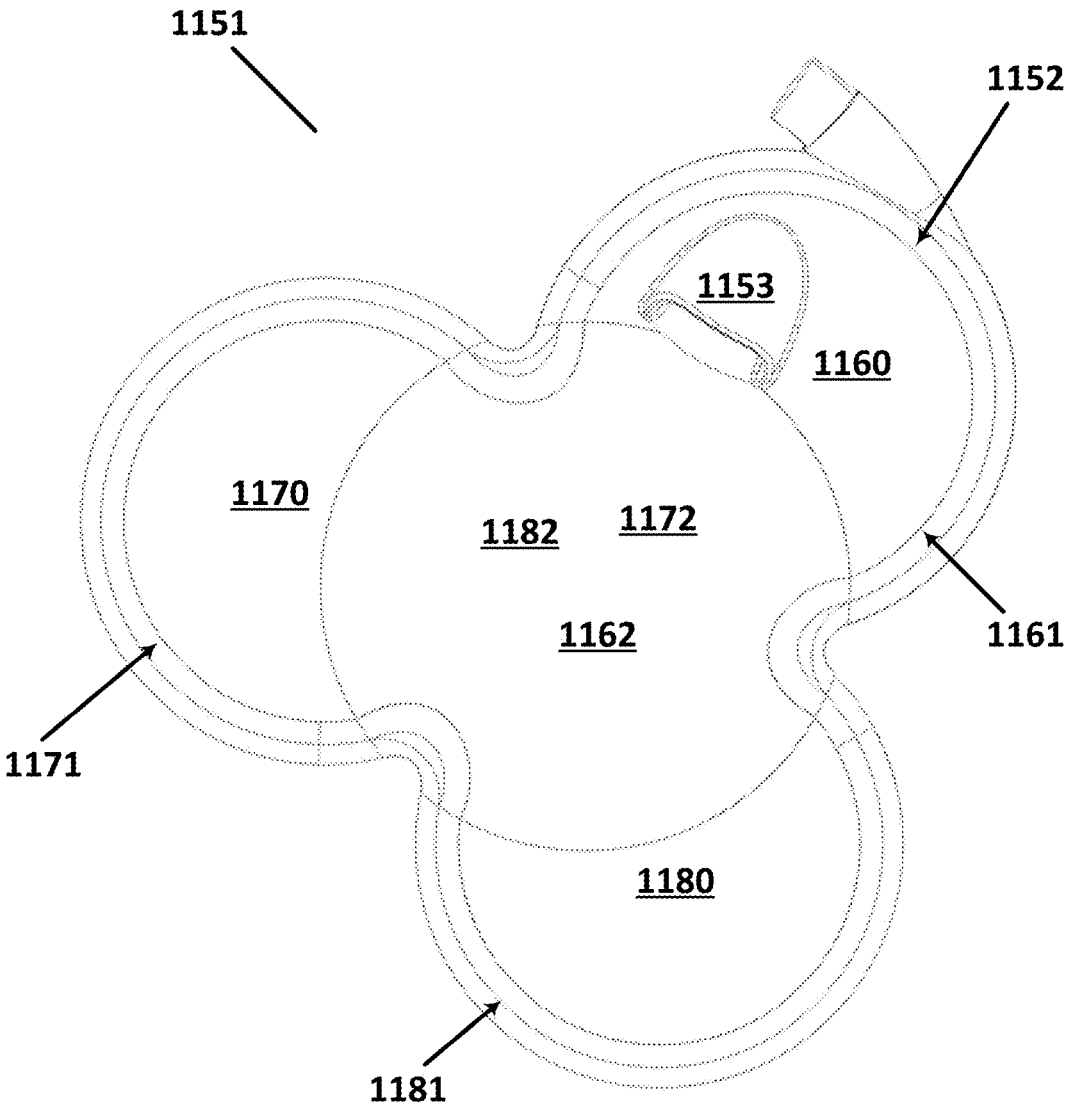
FIG. 11C illustrates an alternative exemplary embodiment of the conjoined bowl feature with three conjoined bowls, three common crossover areas, and an entrance and exit within the first bowl.

In another embodiment the conjoined bowl feature may have three or more bowls in a conjoined bowl feature that is not arranged linearly. For example, as shown in FIG. 11C, an exemplary three bowl configuration of the conjoined bowl feature (1151) could be arranged in a triangular pattern with multiple common crossover areas (1162, 1172, 1182). In the configuration in FIG. 11C, a ride vehicle would enter the conjoined bowl feature (1151) at the conjoined bowl entrance (1152) located on a wall of first bowl (1160). The ride vehicle then rides around the first bowl outer wall (1161) before riding through first common crossover area (1162) and entering the second bowl (1170). The ride vehicle then rides around the second bowl outer wall (1171) before riding through second common crossover area (1172) and entering the third bowl (1180). The ride vehicle then rides around the third bowl outer wall (1181) before riding through the third common crossover area (1182), re-entering the first bowl (1160) and exiting through the conjoined bowl exit (1153). Similarly, a four bowl conjoined bowl feature could be arranged, such as in cloverleaf pattern, with multiple common crossover areas, and so on. In another embodiment the exit (1153) may be in the third bowl (1180). It will be understood that the farther apart the multiple bowls are spaced in this type of configuration, the closer together the multiple common crossover areas will be to each other, and vice versa.

Figure 12A:
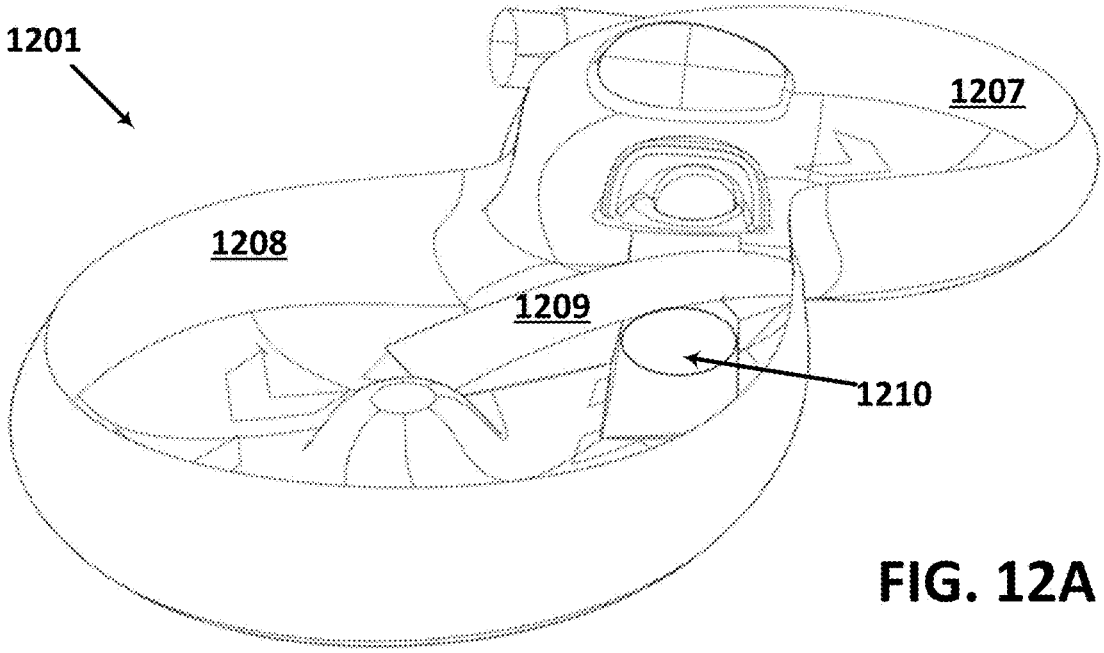
FIGS. 12A and 12B illustrate an exemplary embodiment of the conjoined bowl feature with an underpass and overpass at the crossover section.
Figure 12B:
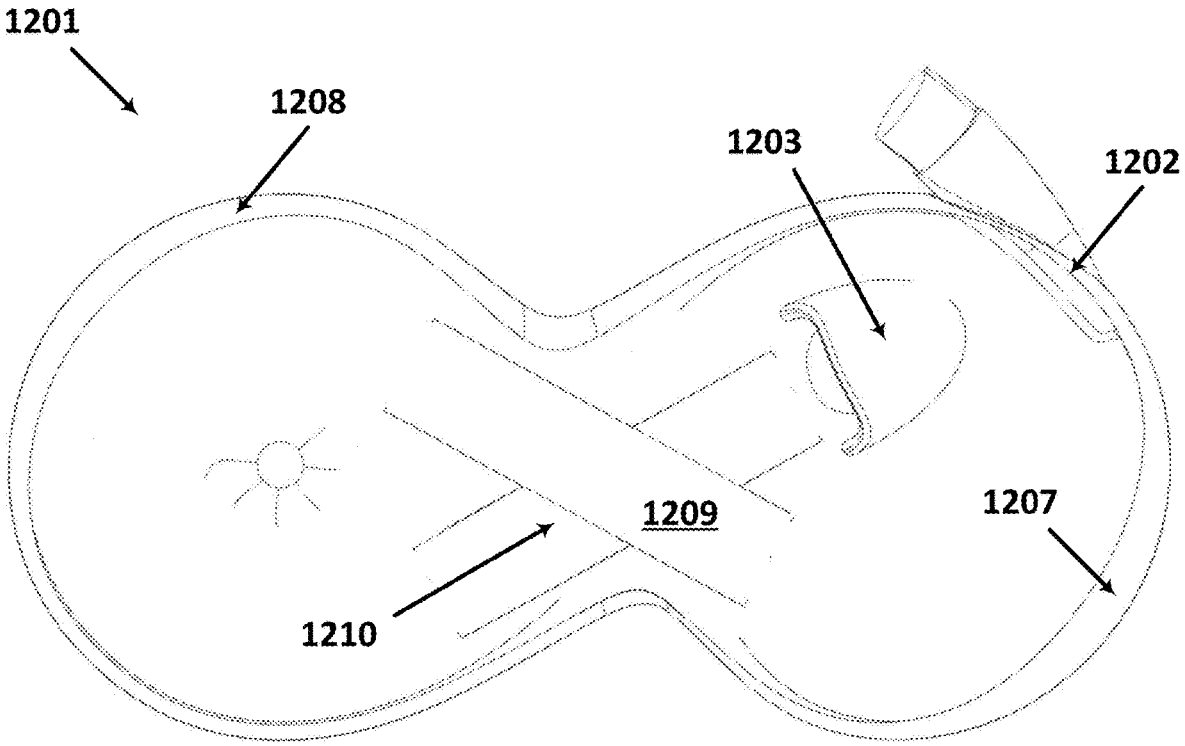

FIG. 12A is a perspective view of an exemplary embodiment of the conjoined bowl feature (1201) with an underpass and overpass at the crossover section. FIG. 12B is an overhead view of the exemplary embodiment (1201) of the conjoined bowl feature depicted in FIG. 12A. It is contemplated that the exemplary embodiment (1201) shown in FIGS. 12A and 12B (and similar alternative embodiments) may be used in place of the conjoined bowl feature (101) depicted in FIG. 1 or in alternative ride configurations.

FIGS. 12A and 12B illustrate an exemplary embodiment of the conjoined bowl (1201). The ride vehicle enters the conjoined bowl feature (1201) at the entrance (1202), the ride vehicle then rides around the first bowl wall (1207) before riding over an overpass (1209) at the crossover area, the ride vehicle then rides around the second bowl wall (1208) before riding through a tunnel (1210) under the overpass (1209) at the crossover area. Finally the ride vehicle exits the conjoined bowl feature (1201) via the exit (1203). In another embodiment the tunnel (1210) under the overpass (1209) may be the exit of the conjoined bowl feature (1201).

In another embodiment the overpass and tunnel may be switched, such that the ride vehicle first goes through a tunnel under the overpass at the crossover area, then around the second bowl wall, before riding over the overpass at the crossover area and finally exiting the conjoined bowl feature via the exit.

Figure 13A:
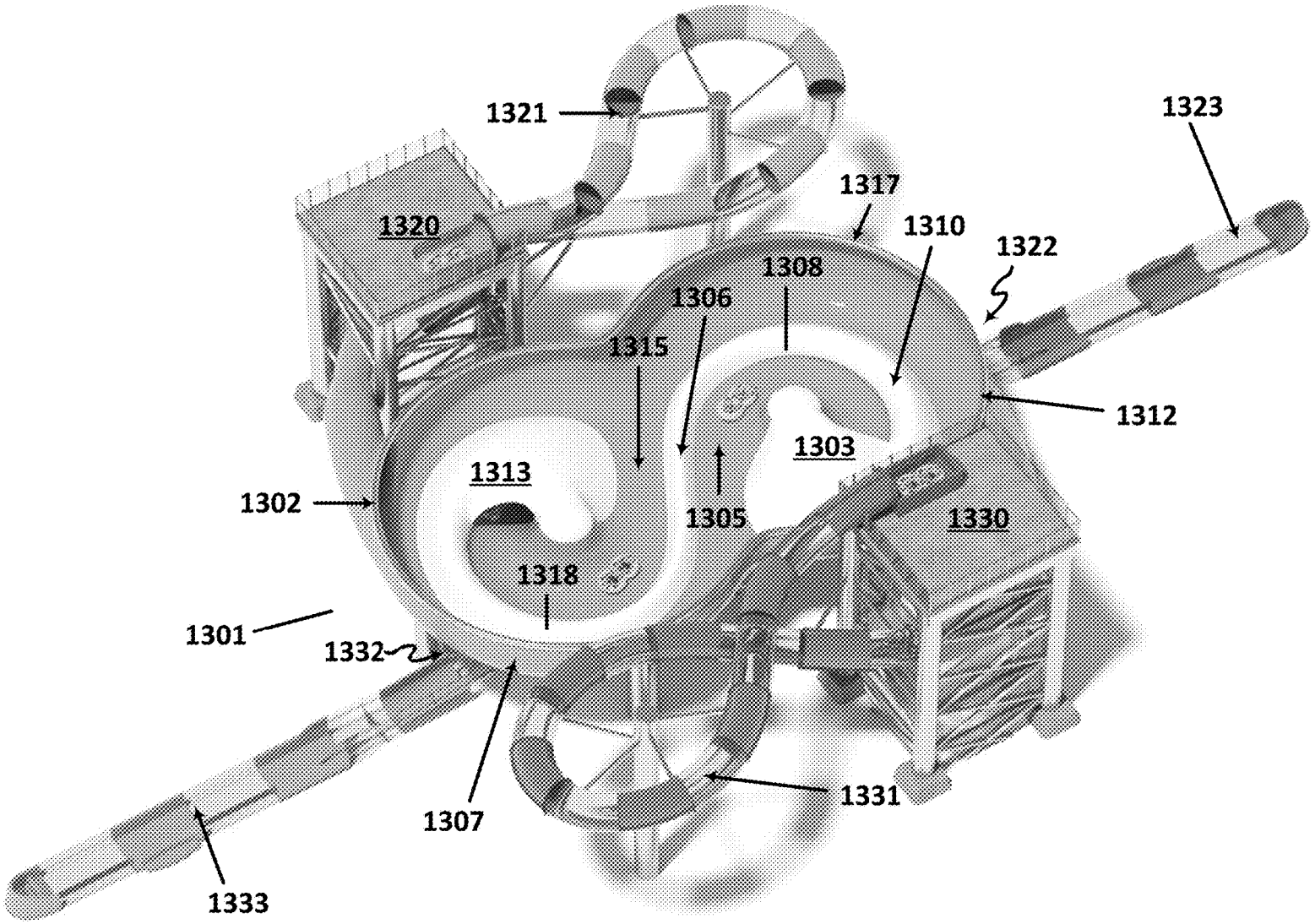
FIGS. 13A and 13B illustrate an exemplary embodiment of the conjoined bowl feature with two independent lanes.
Figure 13B:
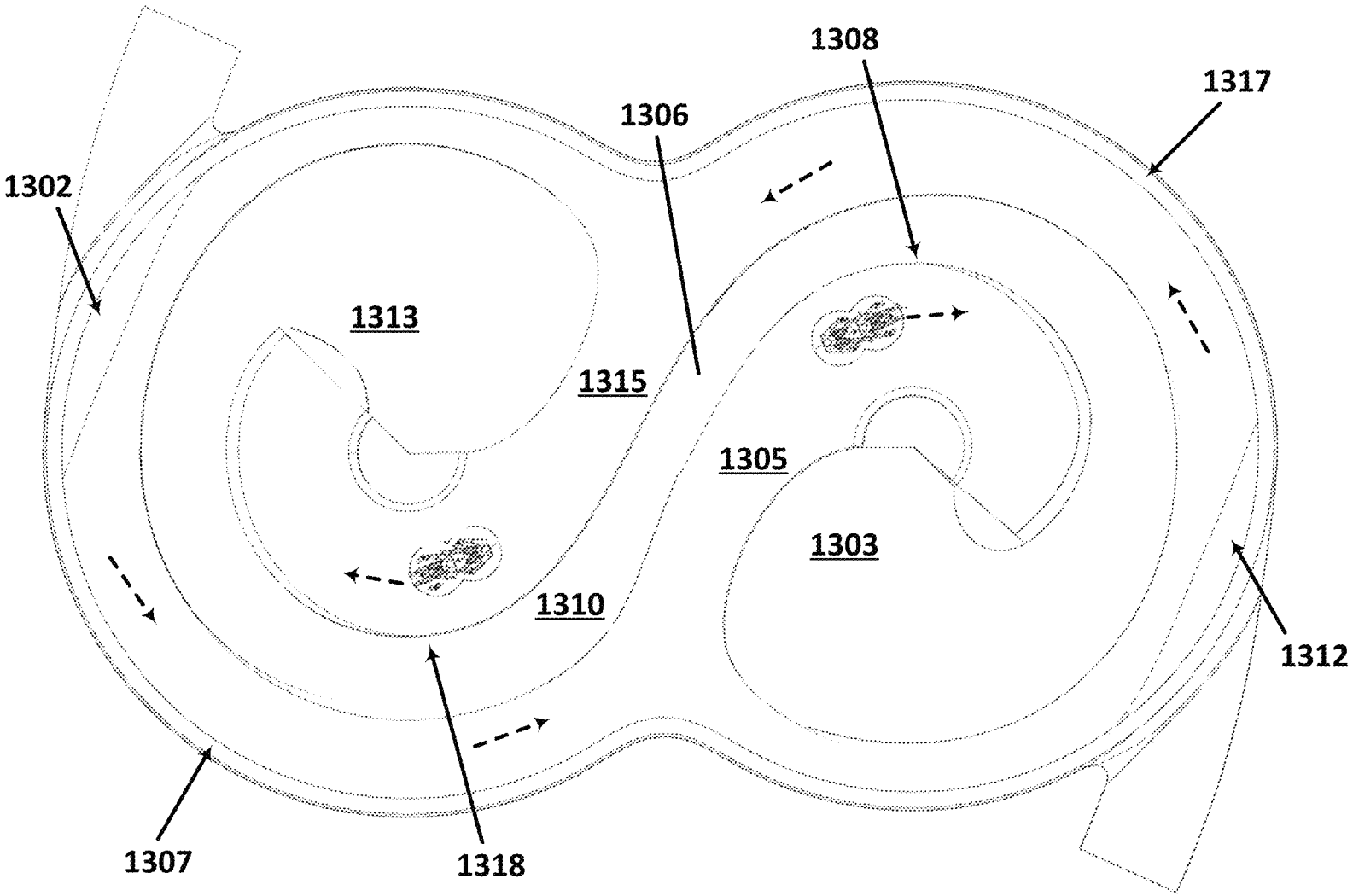

FIGS. 13A and 13B illustrate an exemplary embodiment (1301) of the conjoined bowl feature with two independent lanes (1305 and 1315), two conjoined bowl feature entrances (1302 and 1312), and two conjoined bowl feature exits (1303 and 1313).

FIG. 13A illustrates an example ride configuration that incorporates one exemplary embodiment of a conjoined bowl feature with two independent lanes. From the perspective of a rider in a ride vehicle in a first lane (1305), the conjoined bowls feature (1301) may follow shortly after the entrance to the ride (1320) via a first section of the ride (1321), which deposits the ride vehicle into a first lane (1305) of the conjoined bowl feature (1301) via the first bowl entrance (1302). The ride vehicle may exit the conjoined bowls feature (1301) via the bowl exit (1303) into a subsequent section of the ride (1322) before exiting the ride into a pool or shutdown lane (1323). From the perspective of a rider in a ride vehicle in a second lane (1315), the conjoined bowls feature (1301) may follow shortly after the entrance to the ride (1330) via a first section of the ride (1331), which deposits the ride vehicle into one lane (1315) of the conjoined bowl feature (1301) via the bowl entrance (1312). The ride vehicle may exit the conjoined bowls feature (1301) via the bowl exit (1313) into a subsequent section of the ride (1332) before exiting the ride into a pool or shutdown lane (1333).

FIG. 13A is an overhead perspective view illustrating an exemplary embodiment depicting the ride vehicle paths through the conjoined bowl feature (1301), for each lane (1305 and 1315) the ride vehicle paths approximately follow a "S" shape in the opposite direction to ride vehicles on the opposite path, providing an opportunity for the rider to interact visibly or audibly with riders on the other path. The opposing ride vehicle directions going towards a common area (1306) creates with riders the impression that they may collide. FIG. 13B is an overhead view of the exemplary embodiment of the conjoined bowl feature (1301) depicted in FIG. 13A.

Each lane (1305 and 1315) is separated by a dividing wall (1310). In the exemplary embodiment (1301) the wall is opaque. In another embodiment the separating wall (1310) may be partially or entirely semi-transparent or fully transparent. In the exemplary embodiment (1301) the top of the separating wall (1310) may be lower than the riders' eye level at the crossover section (1306) to allow riders to see over it. In another embodiment the top of the separating wall (1310) may be higher than the riders' eye level at the crossover section (1306) to control the ride vehicles better. In this embodiment the separating wall (1310) may be partially or entirely semi-transparent or fully transparent. In one embodiment, the height of the separating wall (1310) may vary along the length of the rotating feature.

In the first rider lane (1305), the first ride vehicle enters the conjoined bowl feature (1301) at the first bowl entrance (1302); the first ride vehicle then rides around the first bowl outer wall (1307) before riding through the crossover area (1306); the first ride vehicle then rides around the second bowl inner wall (1308); finally the first ride vehicle exits the second bowl via the second bowl exit (1303). In the second rider lane (1315), the second ride vehicle enters the conjoined bowl feature (1301) at the second bowl entrance (1312); the second ride vehicle then rides around the second bowl outer wall (1317) before riding through the crossover area (1306); the second ride vehicle then rides around the first bowl inner wall (1318); finally the ride vehicle exits the first bowl via the first bowl exit (1313).

In another embodiment, the ride vehicles may enter the conjoined bowl feature (1301) at the center of each bowl, where exit locations (1303 and 1313) are shown in the figures, and exit the conjoined bowl feature (1301) at the outer wall, where the entrance locations (1302 and 1312) are shown in the figures; i.e. riding in the reverse direction.

In another embodiment one ride vehicle may enter one lane (1305) at the entrance (1302) and exit the conjoined bowl feature at the exit (1303) of the lane, and another ride vehicle may enter the other lane (1315) at the second lane exit location (1313) and exit the conjoined bowl feature (1301) at the entrance (1312) of the lane; i.e., the ride vehicles are riding approximately side-by-side. In this embodiment, the interaction between riders may be prolonged. It is contemplated that additional lanes may be added by following the same patterns described herein.

In certain embodiments, ride vehicles enter a circular first bowl, making use of the outside wall of the first bowl for a portion, before translating into a subsequent circular bowl where the ride vehicle rides in the opposite direction from the first bowl. Ride vehicles then ride and exit the second bowl along the perimeter (as illustrated in FIG. 7), or spin back into first bowl and out an exit near the center of the first bowl (as illustrated in FIGS. 1, 2A and 2B, for example). In addition, as illustrated in FIGS. 13A and 13B, the invention can accommodate multiple vehicles simultaneously, each entering into the opposing bowl, with a largely predetermined channel each vehicle follows to exit out of the opposing bowl after translating across the threshold between the two bowls.

The bowl structures may have different combinations of curved surfaces and remain within the scope of the instant disclosure. Exemplary embodiments include a concave surface in which portions of the concave surface are curved, linear, or combinations thereof. As illustrated in the exemplary embodiments, the entire concave surface may be curved to create a partial spheroid shape. The concave surface may also include variable radii of curvature, such as to create a flattened or shallower curved section. The concave surface may also be flatted or include planar surfaces, such as along a bottom portion of the concave surface. The bowl structure may also include guide paths or structures, such as projections illustrated in FIG. 1 or grooved paths as illustrated in FIGS. 5A and 5B.

The outside walls of the bowls described herein may be substantially circular in cross section, but may also be ellipsoidal.

Exemplary embodiments described herein may comprise advantages related to the conjoined bowls over existing solutions. The present invention provides advantages over the conventional rides, but it is not necessary to incorporate every feature disclosed herein to be within the scope of the invention. Different features may be utilized in various combinations and remain within the scope of this disclosure.

Advantages of the invention disclosed herein may include a more consistent rider experience, more consistent bowl feature throughput and exit conditions, and/or a unique ride path and ride experience.

As used herein, the terms "about," "substantially," or "approximately" for any numerical values, ranges, shapes, distances, relative relationships, etc. indicate a suitable dimensional tolerance that allows the part or collection of components to function for its intended purpose as described herein. Numerical ranges may also be provided herein. Unless otherwise indicated, each range is intended to include the endpoints, and any quantity within the provided range. Therefore, a range of 2-4, includes 2, 3, 4, and any subdivision between 2 and 4, such as 2.1, 2.01, and 2.001. The range also encompasses any combination of ranges, such that 2-4 includes 2-3 and 3-4.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

When used in this specification and claims, the terms "comprises" and "comprising" and variations thereof mean that the specified features, steps, or integers are included. The terms are not to be interpreted to exclude the presence of other features, steps, or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

The above descriptions of illustrated embodiments of the system, methods, or devices are not intended to be exhaustive or to be limited to the precise form disclosed. While specific embodiments of, and examples for, the system, methods, or devices are described herein for illustrative purposes, various equivalent modifications are possible within the scope of the system, methods, or devices, as those skilled in the relevant art will recognize. The teachings of the system, methods, or devices provided herein can be applied to other processing systems, methods, or devices, not only for the systems, methods, or devices described.

The elements and acts of the various embodiments described can be combined to provide further embodiments. These and other changes can be made to the system in light of the above detailed description.

In general, in the following claims, the terms used should not be construed to limit the system, methods, or devices to the specific embodiments disclosed in the specification and the claims, but should be construed to include all processing systems that operate under the claims. Accordingly, the system, methods, and devices are not limited by the disclosure, but instead the scope of the system, methods, or devices are to be determined entirely by the claims.

While certain aspects of the system, methods, or devices are presented below in certain claim forms, the inventors contemplate the various aspects of the system, methods, or devices in any number of claim forms. Accordingly, the inventors reserve the right to add additional claims after filing the application to pursue such additional claim forms for other aspects of the system, methods, or devices.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A ride feature, comprising:

a first bowl structure;

a second bowl structure, attached to the first bowl structure such that a conjoined bowl structure is formed from the first bowl structure and the second bowl structure, the conjoined bowl structure further comprising:

a rider entrance into the conjoined bowl structure; and a rider exit out of the conjoined bowl structure.

2. The ride feature of claim 1, wherein the rider entrance is located within the first bowl structure, and the rider exit is located within the second bowl structure, such that a rider first rides at least a portion of the first bowl structure, then over a central portion of the conjoined bowl structure between the first bowl structure and the second bowl structure, and finally rides about at least a portion of a circumference of the second bowl structure before exiting out the rider exit.

3. A ride feature, comprising:

a first bowl structure;

a second bowl structure, attached to the first bowl structure such that a conjoined bowl structure is formed from the first bowl structure and the second bowl structure, the conjoined bowl structure further comprising:

a first rider entrance and second rider entrance into the conjoined bowl structure;

a first rider exit and a second rider exit out of the conjoined bowl structure;

the first rider entrance and second rider exit located within the first bowl structure, and the second rider entrance and first rider exit located within the second bowl structure.

4. The ride feature of claim 3, comprising a first ride path from the first rider entrance to the first rider exit, and a second ride path from the second rider entrance to the second rider exit.

5. The ride feature of claim 4, wherein the first ride path and the second ride path travel alongside each other along at least a portion of the ride feature.

6. The ride feature of claim 4, wherein the first ride path and the second ride path are separated by a rider barrier.

7. The ride feature of claim 3, wherein the first bowl structure and the second bowl structure are configured such that a first rider rides at least a portion of a circumference of the first bowl structure after entering through the first entrance, rides through a crossover portion between the first bowl structure and the second bowl structure, and rides about at least a portion of a circumference of the second bowl structure before exiting out the first rider exit; and a second rider rides about at least a portion of a circumference of the second bowl structure after entering through the second entrance, rides through the crossover portion between the first bowl structure and the second bowl structure, and rides about at least a portion of a circumference of the first bowl structure before exiting out the second rider exit.

* * * * *